United States Patent [19]

Clark et al.

[11] 4,066,117

[45] Jan. 3, 1978

[54] SPRAY CASTING OF GAS ATOMIZED MOLTEN METAL TO PRODUCE HIGH DENSITY INGOTS

[75] Inventors: Ian Sidney Rex Clark, Forest Park Greenwood Lake; John Kenneth Pargeter, Warwick, both of N.Y.; John Oliver Ward, Bodenham, England

[73] Assignee: The International Nickel Company, Inc., New York, N.Y.

[21] Appl. No.: 626,304

[22] Filed: Oct. 28, 1975

[51] Int. Cl.[2] ..... B22D 23/00; B05B 7/14

[52] U.S. Cl. ..... 164/46; 118/320; 164/66; 164/133; 164/136; 239/290; 239/296; 239/424.5; 427/422; 427/425

[58] Field of Search ..... 164/46, 47, 66, 133, 164/136; 427/422, 425; 239/290, 292, 296, 297, 300, 400, 420, 424.5; 118/320

[56] References Cited

U.S. PATENT DOCUMENTS

| | | | |
|---|---|---|---|
| 2,024,840 | 12/1935 | Wright | 164/46 |
| 2,715,046 | 8/1955 | Ackerman | 239/300 |
| 2,762,093 | 9/1956 | Hood | 164/46 |
| 2,864,137 | 12/1958 | Brennan | 164/46 |
| 3,182,361 | 5/1965 | Trimble | 239/292 X |
| 3,592,391 | 7/1971 | Bender et al. | 239/424.5 X |
| 3,642,521 | 2/1972 | Moltzan et al. | 427/425 X |
| 3,742,585 | 7/1973 | Wentzell | 427/422 X |
| 3,775,156 | 11/1973 | Singer | 427/422 X |
| 3,988,084 | 10/1976 | Esposito et al. | 239/424 X |

FOREIGN PATENT DOCUMENTS

| | | | |
|---|---|---|---|
| 2,043,882 | 3/1971 | Germany | 164/46 |
| 1,379,261 | 1/1975 | United Kingdom | 164/46 |

*Primary Examiner*—Francis S. Husar
*Assistant Examiner*—Gus T. Hampilos
*Attorney, Agent, or Firm*—Raymond J. Kenny; Ewan C. MacQueen

[57] ABSTRACT

A process is disclosed for producing a high density spray cast metal body from a highly energetic atomized metal stream by directing said atomized stream into the interior of a mold and causing said stream to scan and fill said mold interior by effecting relative movement between said atomized metal stream and said mold, thereby producing a fine grained spray cast metal body of high density.

52 Claims, 18 Drawing Figures

CROSS-SECTION OF TWO DIFFERENT TEEMING NOZZLES

PLENUM CHAMBER PREFERRED SHAPE

DESIGN OF JETS WITH DIMENSIONS

| | | JET NO. | | | | | | |
|---|---|---|---|---|---|---|---|---|
| | | 10 | 10A | 20 | 20A | 25 | 25A |
| THROAT DIAMETER | A (IN) | 0.156 | 0.156 | 0.141 | 0.141 | 0.141 | 0.141 |
| EXIT DIAMETER | B (IN) | 0.212 | 0.212 | 0.205 | 0.205 | 0.227 | 0.227 |
| LENGTH OF TAPER | C (IN) | 0.533 | 0.533 | 0.611 | 0.611 | 0.821 | 0.821 |
| LENGTH OF EXIT | D (IN) | 0.717 | 1.217 | 0.639 | 1.139 | 0.429 | 0.929 |
| EXTENSION FROM PLENUM | E (IN) | 1.5 | 2.0 | 1.5 | 2.0 | 1.5 | 2.0 |
| LENGTH OF JET | F (IN) | 2.0 | 2.5 | 2.0 | 2.5 | 2.0 | 2.5 |

SCHEMATIC ARRANGEMENT OF JETS IN THE PLENUM SHOWING THE LENGTH OF JETS EXTENDING FROM THE PLENUM AND THE DISTANCES FROM THE EXIT OF JETS TO THE FOCAL POINTS

THEORETICAL KINETIC ENERGY GENERATED AT THE EXIT OF A CORRECTLY DESIGNED SUPERSONIC JET WITH THROAT DIAMETER $D_1^*$ AS A FUNCTION OF THE DRIVING PRESSURE OF ARGON

VARIATIONS OF ARGON VELOCITY AND TEMPERATURE AT THE EXIT OF A JET AS A FUNCTION OF ARGON DRIVING PRESSURE IN THE PLENUM

2/3 X

AS-SPRAY CAST SUPERALLOY INGOT

ETCHED 1000 X

AS-SPRAY CAST SUPERALLOY

ETCHED 200X

FORGED SPRAY CAST SUPERALLOY

UNETCHED 200X

AS-SPRAY CAST ZINC

SPRAY CASTING OF GAS ATOMIZED MOLTEN METAL TO PRODUCE HIGH DENSITY INGOTS

This invention relates to a process for producing high density, spray cast metal ingots from atomized molten metal streams and to high density, fine grained spray cast ingots produced by said process.

RELATED CASE

In copending application Ser. No. 533,756, filed Dec. 18, 1974, and assigned to the same assignee, a method is disclosed for the production of superalloy metal powders through the disintegration of molten metal streams by atomization. The subject matter of the foregoing application is incorporated herein by reference.

STATE OF THE ART

The use of powder metallurgy in the production of metal shapes is well known. Broadly speaking, a known method is to compact metal powders in a die to produce a desired shape and then sintering the shape to obtain as far as it is possible the desired physical properties. However, there is a limitation to this method in that generally the resulting product has undesirable amounts of oxygen which adversely affect the properties of the final product and, moreover, the final product also tends to exhibit undesirable amounts of porosity. Thus, in order to remove the porosity, it has been proposed to subject the sintered shapes to cold and/or hot working. While it has been possible to produce high density material by this method, residual oxygen content was still a problem, particularly in the powder metallurgy production of superalloy shapes.

Recently, a process has been proposed for the direct fabrication of metal shapes of long length and relatively thin cross section by powder metallurgy using gas atomizing techniques. The process comprises depositing a plurality of coherent layers of metal on a plurality of substrates by directing streams of gas-atomized particles of molten metal onto the substrates to coalesce and form coherent layers of metal onto the substrates and then hot working the metal layers together by the action of heat and pressure to weld the layers together and form a single layer while the metal is at a temperature above its recrystallization temperature as a result of the initial heat in the atomized particles of molten metal.

According to this process which is disclosed in U.S. Pat. No. 3,670,400 by A.R.E. Singer (issued June 20, 1974) and which is particularly applicable to the production of aluminum strip, atomized aluminum is spray cast onto a moving target, such as a steel belt or a roll having a release agent thereon (e.g. graphite) and the sprayed strip, while still hot, removed and hot rolled to the desired gage. Strip thicknesses of up to about 0.5 inch may be produced, with the thickness generally ranging from about 0.01 to 0.375 inch.

The patent states, however, that the porosity of the deposited layers ranges from about 15% to 20% which is undesirably high. Thus, Singer is forced to hot work the deposited layers in order to effect substantially complete densification of the spray cast strip.

The foregoing process is also discussed by the patentee in the publications *Light Metal Age,* (pps. 5–8, October, 1974) and in *Metals and Materials,* (pps. 246–250, June 1970).

Recently British Pat. No. 1,379,261 issued to Reginald Gwyn Brooks on Jan. 2, 1975, relating to the production of shaped precision metal articles from molten metals and alloys by spray casting atomized metals or alloys into a deposition die contoured to the shape of the desired article. Broadly stated, the method comprises directing an atomized stream of molten metal or alloy onto a collecting surface to form a deposit, and then directly working the deposited material on the collecting surface by means of a die to form the desired shape and then subsequently removing the worked shape from the collecting surface. The purpose of the working is to densify the metal deposit which is porous.

This is brought out on page 2, lines 73–79, of the British patent (second column) in which it is stated that the forming operation is normally carried out as soon as the required mass of metal has been deposited onto the die or collecting surface. However, it is also stated that, when necessary, the spray deposit can be cold formed after it has been cooled to form, for example, a highly porous article, thus indicating that the as-sprayed material is very porous.

It is obvious from the foregoing spray casting methods that the metal product produced in the spray cast state is quite porous and, therefore, must be subjected to vigorous working to densify the product and remove the porosity wherever possible.

In recent years, research efforts have been intensified in the development of superalloys capable of withstanding the increasingly severe operating conditions, notably higher temperatures and stress which exist in jet engine power plants, particularly in turbine engine development. The alloys developed which have shown great promise generally exhibited poor hot workability and fabrication characteristics, especially when increasing amounts of matrix strengthening elements were added to superalloy compositions of the nickel-base and cobalt-base types. As a consequence, such alloys have been normally used in the cast form, despite attendant drawbacks, such as segregation abnormalities and formation of relatively coarse dendrites associated with cast structures, the cast form having certain inherent limitations with regard to properties and product shapes that can be produced. Vacuum casting was resorted to in order to keep the oxygen content as low as possible.

It would be desirable to provide a method for spray casting metals and alloys, particularly difficult-to-work superalloys, and produce spray cast ingots characterized by very high density, minimum porosity and a fine grained structure such that substantially all of the dendrites that form do not exceed the average fine grain size of the cast metal. The term "metal" is used herein interchangeably with the term "alloy", it being understood that the term "metal" may include one or more metal elements in the composition thereof.

OBJECTS OF THE INVENTION

It is thus an object of the invention to provide a process for spray casting metals into a mold and produce a fine grained ingot of low porosity.

Another object is to provide a process for producing a high density spray cast ingot of a superalloy composition very low in oxygen and having a density of substantially over 90%, e.g. at least about 95%, of the actual density of the alloy.

A still further object of the invention is to provide a process for producing a cast ingot of a complex high temperature superalloy selected from the group consisting of nickel-base, cobalt-base and iron-base superalloys by atomizing and spray casting a molten stream of said alloy using non-oxidizing gas, such as argon, jet-propelled at supersonic velocities.

Another object is to provide a spray cast ingot of a metal using atomizing techniques, wherein said ingot has a fine grained structure, is low in oxygen and is characterized in the spray cast state by a density of substantially over 90%, e.g. at least about 95%, of the actual density of the metal.

These and other objects will more clearly appear from the following disclosure and the accompanying drawings, wherein.

Figure 13:
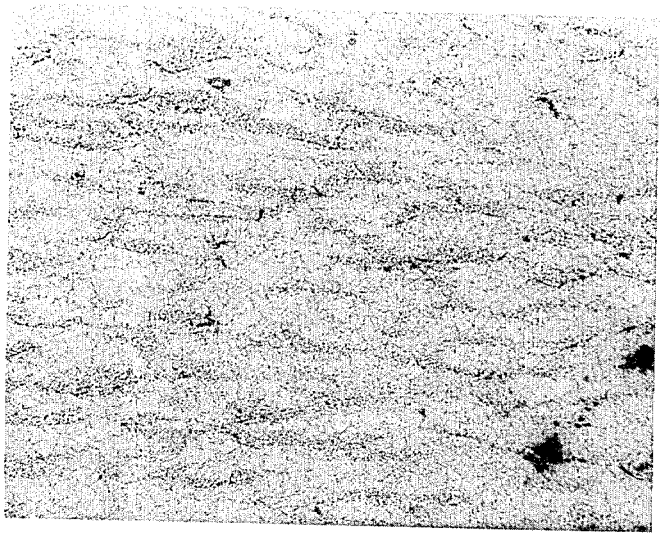
Figure 14:
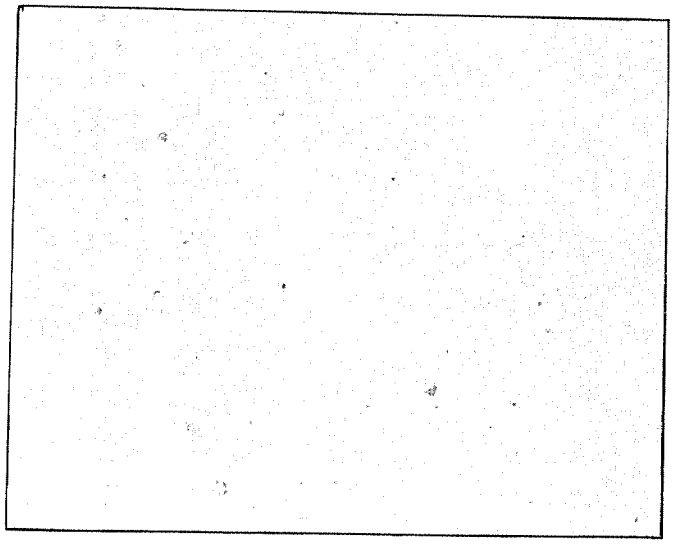

FIG. 13 is a reproduction of a photomicrograph taken at 200 times magnification of an etched section of a forged disc formed from a spray cast ingot of a superalloy produced in accordance with the invention, the photomicrograph showing elongated fine grains substantially each surrounded by a necklace-like structure of very fine grains; and FIG. 14 is a reproduction of a photomicrograph of an unetched section of a spray cast ingot of zinc produced in accordance with the invention taken at 200 times magnification.

STATEMENT OF THE INVENTION

Generally speaking, the invention is directed to a process of producing a spray cast metal ingot characterized by exceptionally high density in the as-spray cast condition, the process comprising providing a highly energetic conically configurated outwardly expanding atomized molten metal stream having an included angle of substantially less than 25° and directing said atomized of metal into the cavity of an ingot mold with the axis of said stream disposed at an acute angle to the interior wall of said mold, while effecting relative movement between said atomized metal stream and said mold, such that the atomized metal stream is caused to scan the interior of said mold, and filling said mold while scanning the interior thereof.

A preferred embodiment comprises providing a teeming stream of molten metal formed by passing the stream through a nozzle, allowing said molten stream to pass longitudinally and centrally through a hollow converging conical jet stream of an atomizing fluid, for example, a jet stream of super cooled non-oxidizing gas, such as argon, flowing at supersonic velocity downwardly and axially of said molten metal stream, the conical gas stream being focused at said supersonic velocity to impinge substantially symmetrically against said coaxially disposed molten metal stream in the direction of flow thereof and at a conical angle of less than 30° to produce by impingement a highly energetic conically configurated atomized stream of molten metal expanding outwardly at an included angle of substantially less than 25°. The foregoing stream is then directed into the interior of an ingot mold supported transverse to the path of the energetic metal stream, with the longitudinal axis of said metal stream disposed at an acute angle to the interior wall of said mold, while effecting relative movement between the atomized stream and the mold such that the atomized metal stream is caused to scan the interior of the mold and fill it, thereby producing a compact high density ingot in the as-spray condition having an average density of substantially over 90%, for example, at least about 95%, of the actual density of said metal. With the foregoing process, castings of up to 10 inches in diameter and upwards of about 7 or 8 inches high have been produced.

In carrying out the invention, the molten metal is atomized under non-oxidizing conditions, a preferred method comprising tapping molten metal into a teeming vessel, e.g. a tundish, teeming the metal through a nozzle located in the bottom of the tundish to form a molten stream and subjecting the teeming stream of molten metal to the action of an atomizing gas, the gas being discharged under pressure through a plurality of jets arranged in a circle and angled to the horizontal to define a converging conical stream of high velocity gas, that is, supersonic velocity, which is focused to impinge coaxially against the teeming stream of molten metal at an included conical angle of less than 30° to form a conically configurated outwardly expanding atomized stream of molten metal characterized by high kinetic energy and temperature which is directed to a confining mold disposed in the path of the atomized metal stream.

A method of effectively scanning the interior of the mold with the atomized metal stream is to move the mold transversely relative to the stream. Thus, the mold may be moved transversely of the stream by rotating it about its axis so that the mold rotates across the metal stream. Another method is to support the mold on an arm and cause the arm to oscillate back and forth transversely so that the mold moves across the metal stream. A preferred embodiment is to rotate and transversely oscillate the mold across the path of the atomized metal stream, with the longitudinal axis of the atomized metal stream making an acute angle with the inner surface of the wall of the ingot mold. This can be achieved by tilting slightly the conical metal stream, or by having inclined mold walls or by tilting the mold relative to the axis of the metal stream.

Preferably, the arrangement of the jets is such as to produce a relatively tight cone of atomized metal having an included angle of substantially less than 25°, e.g. up to about 20°, such as 5° to 15° and, more preferably, 5° to 10°. The foregoing, together with the preferred embodiment of rotating and transversely oscillating the mold in the path of the atomized metal stream assures spray castings having highly desirable physical properties, such as ingots very low in oxygen content (about one-half that of metal powders), high density, good strength and ductility, fine grain size (e.g. ASTM 7 to 8) and substantial avoidance of particle boundaries as is typical of metal spraying onto a flat substrate. When spray casting superalloys which form $\gamma'$ precipitates, metal carbide networks at the grain boundaries are substantially inhibited, and the $\gamma'$ precipitate is relatively well distributed in the matrix with a slight excess at the grain boundaries. Moreover, porosity is substantially decreased to provide an as-sprayed cast density of at least 95% of the actual density of the metal being sprayed. This is a marked improvement over prior spray casting techniques.

The improved results of the invention will be clearly apparent in the light of the following disclosure based on the handling of 50 to 100 lb. melts in a high frequency furnace enclosed within an airtight container capable of developing high vacuum and of holding oxygen-free argon, the container also having confined therein a plenum chamber with gas jets communicating therewith, a tundish with a nozzle of predetermined size in the bottom thereof and an ingot mold supported across the path of travel of atomized metal with means coupled to said mold for effecting the movement thereof in a prescribed pattern to provide substantially uniform filling of said mold during atomization of a molten metal stream and produce low porosity ingots.

THE ATOMIZING AND CASTING APPARATUS

Figure 1:
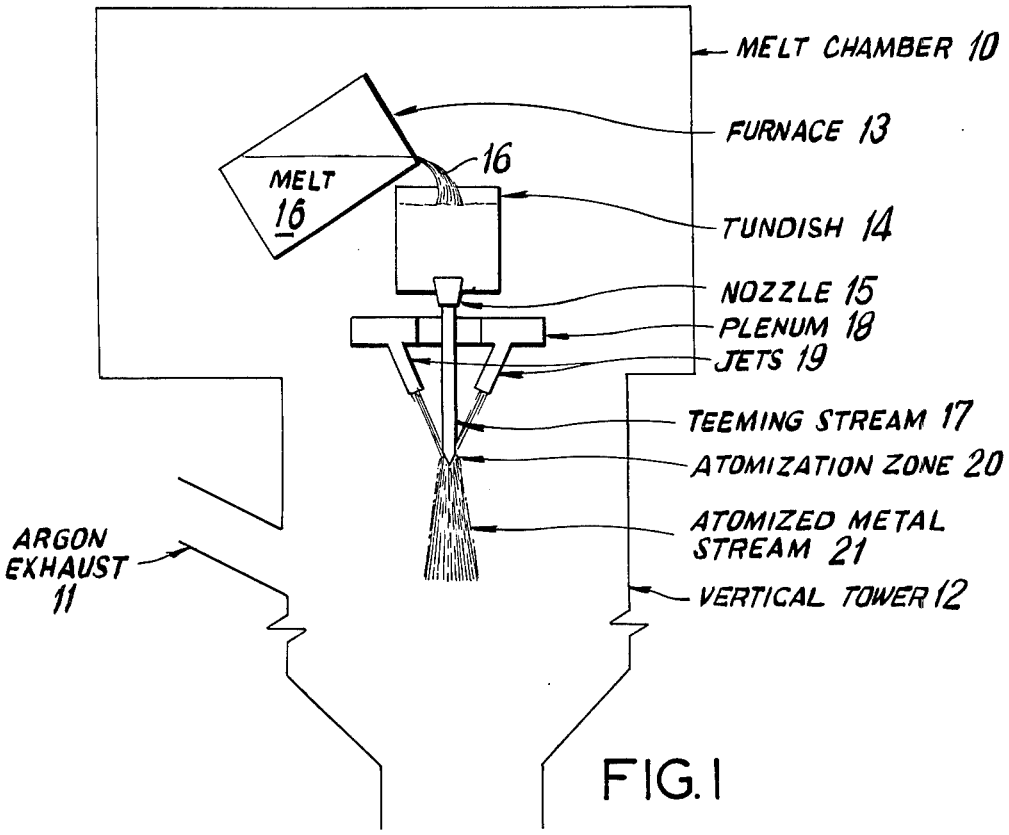
FIG. 1 depicts schematically an atomizing and casting apparatus including the components making up the apparatus, said components being shown in more detail in FIG. 5A.
Figure 5:
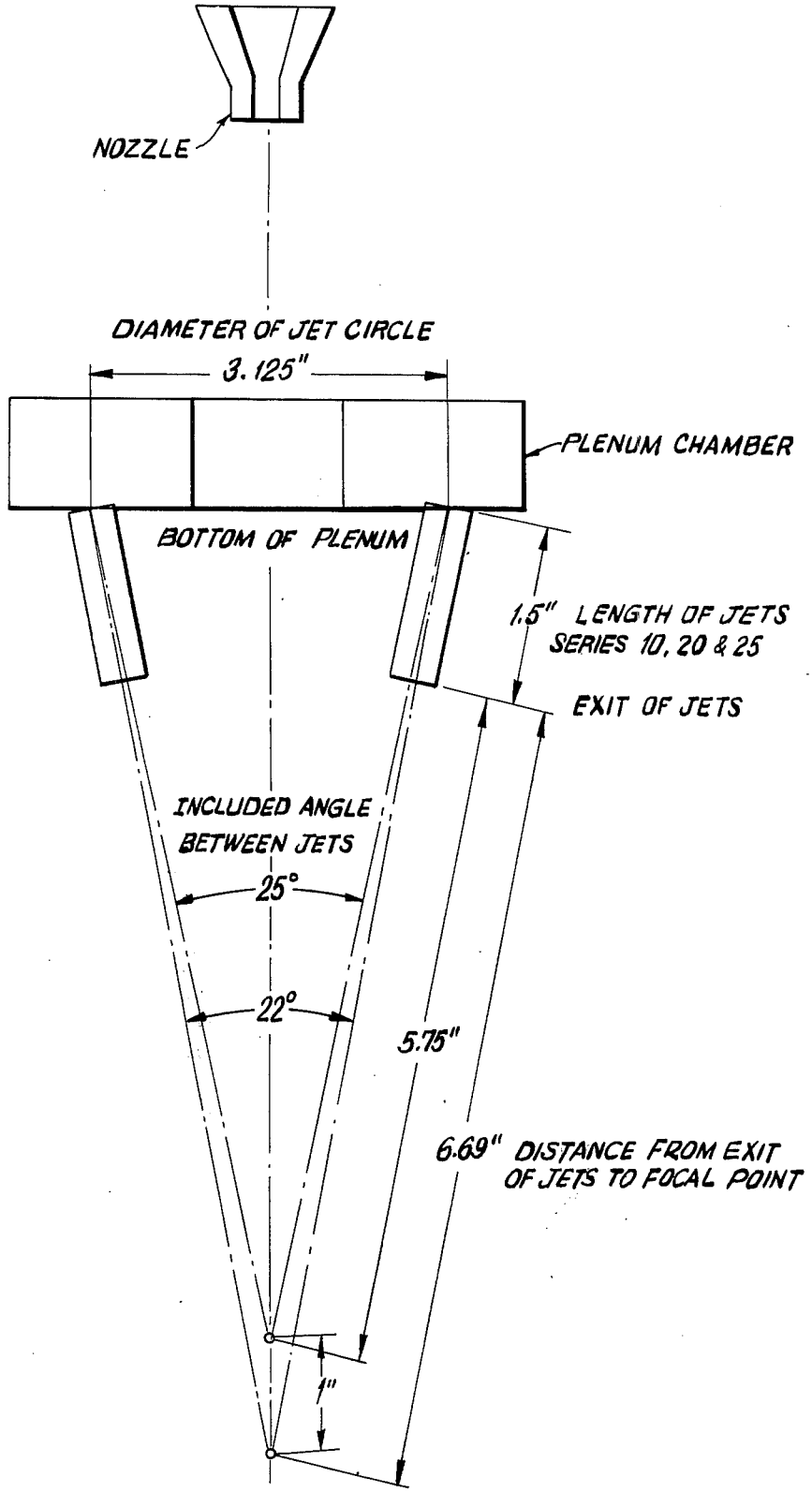
FIG. 5 is illustrative of a preferred embodiment of a plenum chamber and gas jets arranged to provide a double mode impact system for atomizing a molten metal stream.
Figure 5A:
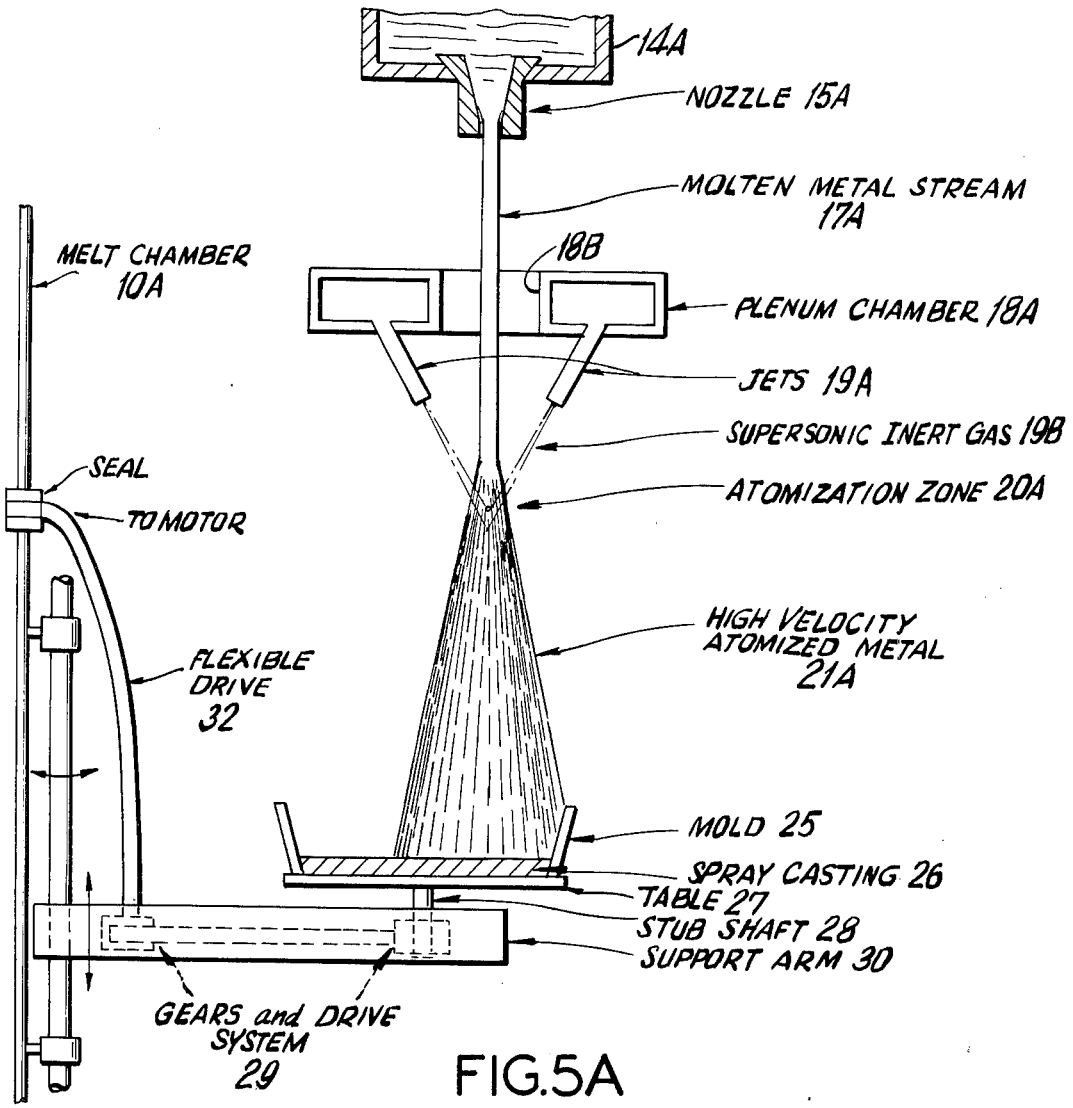
FIG. 5A depicts one embodiment of a spray cast assembly for carrying out the process of the invention.

The atomizing and casting apparatus is shown in FIGS. 1 and 5A comprising an enclosed melt chamber 10 with an argon exhaust at 11, the chamber communicating with vertical tower 12 extending downwardly therefrom. The melt chamber has supported within it a melting furnace 13 (generally a high frequency furnace), a tundish 14 with a nozzle 15 extending through its bottom through which molten metal 16 is teemed at a predetermined average rate to provide a teeming stream 17 of said molten metal passing through the center opening of an annular plenum chamber 18 having a plurality of jets 19 converging downward to produce a high volocity conically configurated gas stream adapted to strike the teeming stream of metal at atomization zone 20 as shown and provide a fairly narrow cone of atomized metal 21 which is directed to a mold not shown but which is illustrated in FIG. 5A. Other details are given as follows.

TUNDISH

It is preferred in one embodiment of the invention that the tundish (holding vessel) should be capable of holding a portion of a melt at depths up to 10 inches or more, a preferred depth being from about 6 to 10 or 12 inches, depending upon the teeming rate to be employed. A 6-inch diameter vessel has been found quite satisfactory for 100-lb. melts, larger vessels being desirable for larger size melts. The tundish should preferably be heated separately from the furnace and be capable of maintaining the melt up to desired temperature, advantageously about 60° C above the liquidus temperature (approximately up to about 1600° C in the case of nickel and/or cobalt-base superalloys).

It might be mentioned that the temperature at which the melt is tapped from the melt furnace to the tundish is important. While it should be sufficiently high to prevent freeze-up in the tundish nozzle, it should be low enough so that the atomized particles solidify rapidly with fine grains and low oxygen pick-up. It is important that the tundish be preheated before pouring the molten metal therein. The preheat temperature is generally at least about 120° C.

TEEMING NOZZLE

Figure 2A:
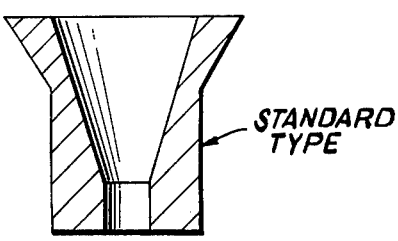
FIGS. 2A and 2B illustrate two different tundish teeming nozzles, a smooth bore venturi and a shape-edge orifice, respectively.
Figure 2B:
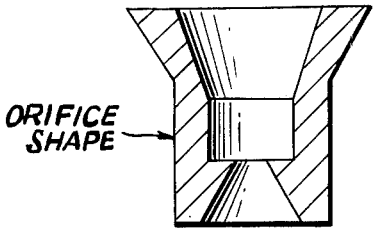

The teeming nozzle is supported in the tundish (note FIGS. 1 and 5A), its function being to meter the molten metal into the atomization zone. While a teeming nozzle of the smooth bore venturi type of FIG. 2A is generally used, it is sometimes more advantageous to use a sharp-edged orifice nozzle of the type illustrated in FIG. 2B even though this type of nozzle might offer less resistance to turbulence in the tundish than would the venturi profile.

The orifice-type nozzle above mentioned (FIG. 2B) is the result of extended investigation and experimentation. We have found this nozzle beneficial by reason of a low discharge coefficient, approximately 0.65–0.75 in comparison with unity as is the case generally with standard nozzles. This offers a larger opening for a given flow rate. Yet, it maintains sufficient stream stability. Therefore, alloys prone to nozzle blockage, e.g., those having a large solidification range, can be teemed more successfully because of the larger opening required for a given flow rate. It has the additional advantage as a result of the smaller mass of nozzle to conduct less heat away from the metering restriction. Moreover, our investigations reflect that the atomizing medium tends to accelerate about the sharp orifice edge and this lends to minimizing nozzle blockage.

The teeming or tundish nozzle is preferably made of ceramic, such as zirconia. In minimizing nozzle blockage, a throat diameter of about 3/16 to 11/32-inch is generally satisfactory. For venturi or smooth bore nozzles, a throat diameter of $\frac{1}{8}$ to $\frac{3}{8}$ inch is generally suitable.

It should be noted that, with other atomization parameters held constant, the smaller nozzle diameters give smaller powder particles at the expense of slower teeming rates and higher gas consumption. On the other hand, the large nozzles result in coarser particles, faster teeming rates and lower gas consumption.

TEEMING RATE

The metal teeming rate from the tundish is influenced principally by the throat diameter of the nozzle (the teeming rate being approximately proportional to throat diameter) and by the head of metal in the tundish (teeming rate being virtually proportional to the square root of the melt height in the tundish). For a given gas flow rate, the lower teeming rates produce smaller powder particles. To assure a uniform atomized stream and to optimize gas consumption, the rate of teeming is beneficially controlled to between about 10 and 70 kg/min.

and, more preferably, from about 25 to 50 kg/min., the teeming nozzle throat diameter being preferably above about 0.2 inch and ranging up to about 0.375 inch, particularly from about 0.25 to 0.30 inch.

PLENUM CHAMBER

Figure 3:
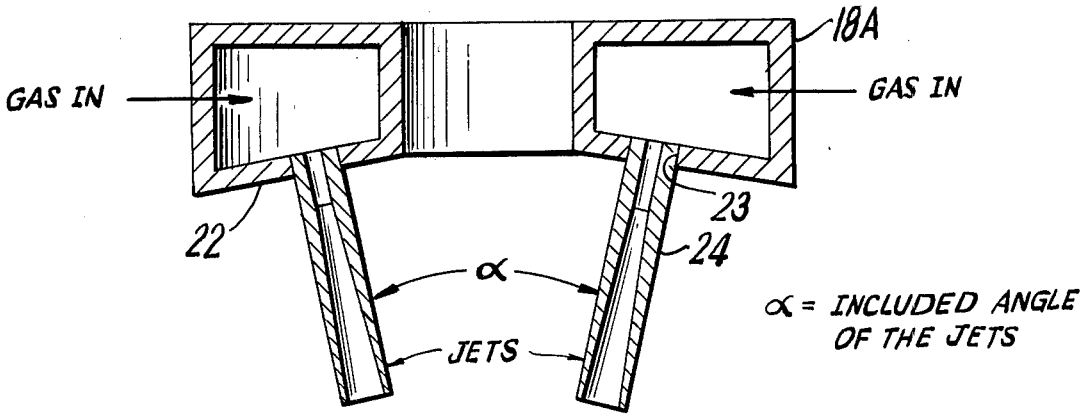
FIG. 3 represents a section of a plenum chamber.

An illustrative plenum chamber 18A is shown rather schematically in FIG. 3.

While the plenum chamber can take virtually any shape, it is preferably made in the shape of a hollow annulus to permit the molten metal being teemed to pass through the central opening thereof and to feed argon to the gas jets at the bottom. The outside surface can, of course, be modified for ease of fabrication. The diameter of the central hole should be at least about 1½ or 1¾ inches to permit sufficient clearance for the metal stream. On the bottom surface 22 of the plenum, spaced openings 23 are provided arranged in a circle into which venturi gas jets are inserted.

The diameter of the circle through the center of the holes (jet circle diameter) used to secure the jets can range from about 2 to 6 inches or more, the diameter preferably being about 2½ to 4 inches. A jet circle diameter of 3 to 3⅛ inches is a good compromise so as to keep the metal stream away from the gas jets and so as to extend the gas jets close to the atomization zone to minimize energy losses in the gas. The included angle $\alpha$ is preferably that value which will provide a converging cone of supersonic gas with an included angle of less than 30° and provide an atomized outwardly expanding conically configurated stream of metal with an included angle at the atomization zone of less than 25°.

The chamber should withstand pressures of up to at least 600 psi, and be adapted to receive gas on both sides as shown in FIG. 3. A gauge can be used outside the atomizer to record the driving gas pressure for the gas jets via a third tube into the plenum.

GAS JET PROFILE

The gas jets 24, which can be formed of any suitable material, e.g., brass, are preferably of the venturi convergingdiverging type. Such jets accelerate the gas smoothly up to the throat where it reaches, say, Mach I, and then accelerate it along the gradually diverging bore to from, say, Mach I up to about Mach 4 or 5 at the exit. Past the exit, gas velocity decreases but maintains a supersonic tongue up to 3 inches or more.

Figure 4:
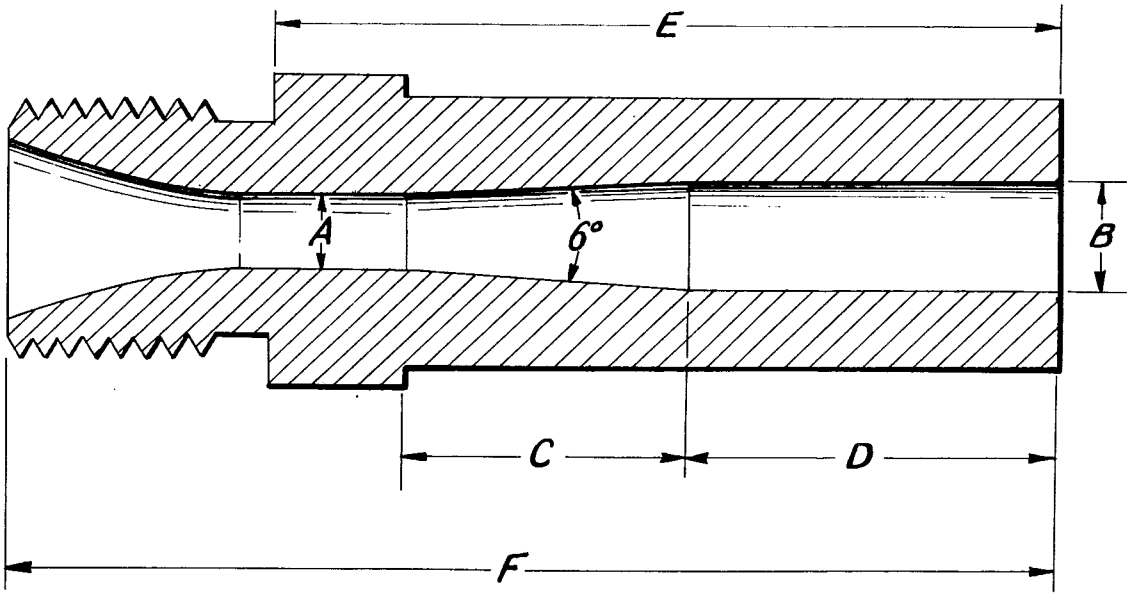
FIG. 4 depicts a profile cross section of a preferred jet embodiment.

The two important dimensions of the jets are throat diameter and length of tapered section. The finish of the bore should be as smooth as possible without abrupt changes in cross section. The design and dimensions of preferred jet embodiments is depicted in FIG. 4. Jet No. 10A differs from 10 in being ½-inch longer, i.e., length of exit from the plenum. The same applies to jets 20 and 20A and jets 25 and 25A. The longer jets are advantageous in that the kinetic energy of the gas decays less before it strikes the molten metal stream.

To secure the jets, plugs are welded into the plenum (note FIGS. 8 and 9) and allowed to protrude slightly beyond the bottom surface. The face of the plug is machined to provide a seat for the plug and to ensure it is aimed correctly. The plugs can be replaced without the need to build another plenum.

GAS JET ASSEMBLAGE

Figure 8:
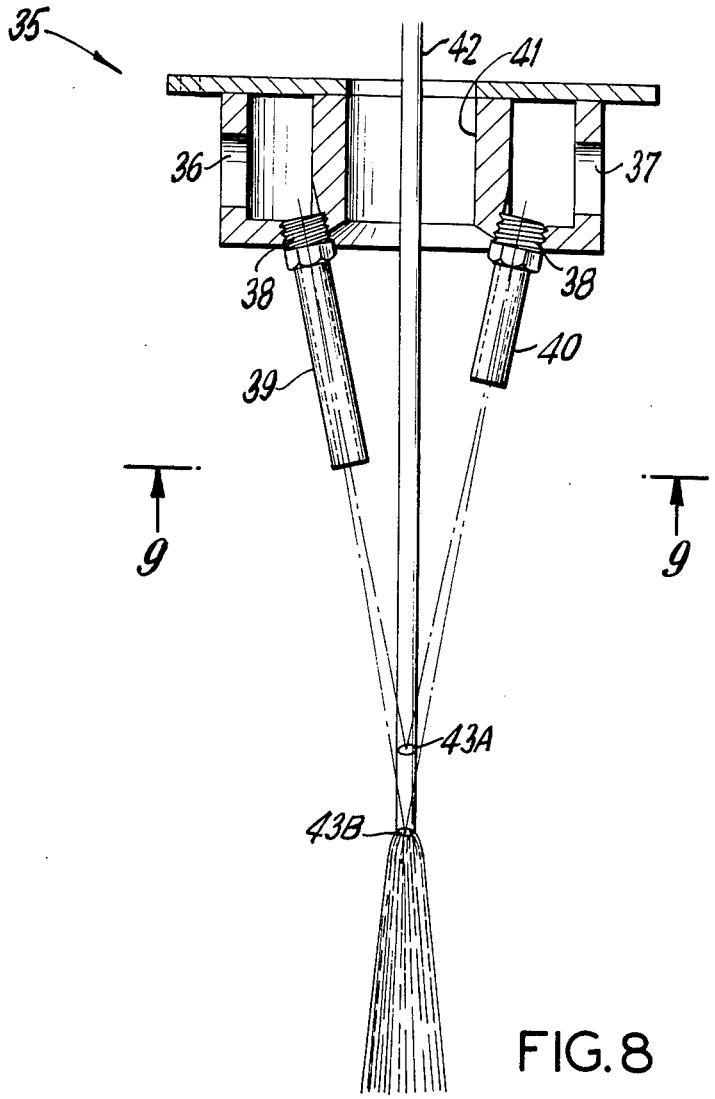
FIGS. 8 and 9 are elevational and bottom views of a double mode impact assembly similar to FIG. 5 but showing the effect of the double mode impact in producing a tight or narrow conical stream of atomized metal, FIG. 9 being viewed in the direction 9—9 of FIG. 8.

While the invention is not restricted to the use of any specific number of jets, it is preferred that eight, approximately equally spaced, jets be utilized. The jets are preferably designed so that four of the jets, the "second set", provide a gaseous stream that strikes the falling molten stream below the point at which the gaseous stream of the other four jets, i.e., the "first set" strikes as shown in the schematic of FIG. 5. Each of the jets of the first set of jets is alternately spaced with each of the jets in the second set. This configuration provides a "double impact mode" of impingement, with the second set helping to create the narrow powder cone profile as depicted in FIG. 8, FIG. 5 showing schematically the double impact mode. The first set in FIG. 5 provides for gas impingement at an included angle of 25° while the second jet provides for gas impingement at an included angle of 22°.

The direction in which the jets exhaust the gas is of considerable importance. Generally speaking, the included angle of the jets (FIG. 5) of the "first set" should preferably be less than about 30° and, most beneficially, is not more than about 25° to 27°, the preferred angle being about 24° to 26°, correlated to preferred teeming rates. With regard to the "second set of jets," while the included angle could be that of the primary set, it is preferred that it be less than that of the "first set" and preferably be at least 2° or 3° less, a preferred included angle being from about 21° to 23°. The two angles for alternate opposed jets consistently confine the atomized metal into a tight or narrow cone with an included angle substantially below 25°, e.g., up to about 20°, preferably about 5° to 15° and, more preferably, 5° to 10°. It might be added that lower energy jets (the short jets) perform better if the included angles are increased slightly to decrease the distance over which the energy decays. Higher energy jets (the longer jets) require the smaller included angles.

Figure 7:
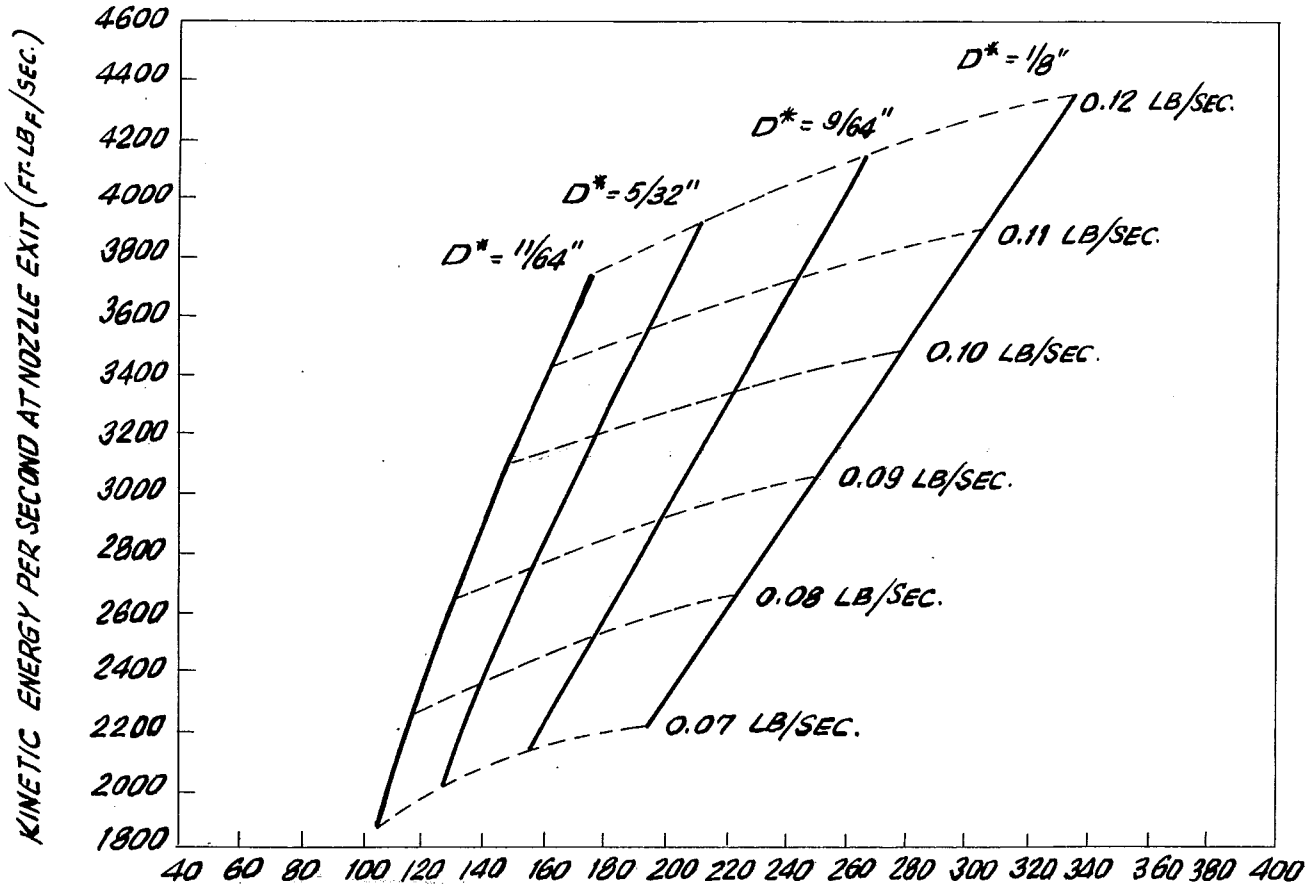
FIG. 7 shows the relationship between argon driving pressure, jet exit diameter and energy generated at jet discharge of the gas.

In terms of the mass flow rate of gas discharged from the jet, it is preferred that the supersonic exit velocity be at least Mach No. 1.5, particularly a velocity greater than Mach No. 2.0. In this connection, the energy (kinetic) available at the jet exit largely depends upon the gas driving pressure and throat diameter. This is depicted in FIG. 7, the information being based upon theoretical considerations. Thus, the same energy generated with a relatively large throat diameter can be generated with a jet of smaller diameter providing the driving pressure is increased. The reduction in gas consumed by reason of using a high driving gas pressure and smaller throat diameter is balanced by the higher gas velocity, hence, higher kinetic energy, at the jet exit. This is important in producing dense spray castings of superalloys and low porosity.

However, there is a limit to how far the jet exit diameter can be decreased since, to maintain the mass flow rate of gas requires that the gas be disproportionately increased. For a given Mach number, the length of the supersonic cone of gas delivered to the atomization zone decreases much in proportion to the decrease in exit diameter. Put another way, the smaller the exit diameter, the less effective is the energy transfer from jet to atomization site.

THE SPRAY CASTING ASSEMBLY

The foregoing components, tundish, plenum, nozzles, etc. operate within chamber 10 (note FIG. 1 and also FIG. 5A) which, for many metals or alloys, including the superalloys, is maintained under vacuum during melting. This chamber should be capable of holding a vacuum of 10 microns of Hg or less. Sufficient space is provided below the tundish for supporting the ingot mold.

By employing a narrow conically configurated atomized stream of metal, the bulk of the stream is captured by the mold. Following formation of the vacuum to remove oxygen present, it is preferred that the melting chamber be back filled with argon to a pressure of about one-sixth atmosphere, otherwise, high pressure argon discharged from the jets at supersonic velocity into high vacuum tends to explode in all directions and thus physically and adversely affect the preferred configuration of the molten metal stream.

Referring to FIG. 5A, the main parts of the casting assembly are shown comprising tundish 14A with nozzle 15A at its bottom, the assembly including plenum chamber 18A through the center opening 18B of which molten metal stream 17A flows downwardly to be disintegrated by preferably a supersonic stream of inert gas (argon) 19B at atomization zone 20A using preferably the double impact mode embodiment discussed hereinbefore. The invention is not limited to double mode impact. A single mode impact may be employed or two or more. The important thing is to produce a fairly tight narrow cone of atomized metal.

Preferably, a tight or narrow cone 21A is produced having an included angle of less than about 20° which provides a high density atomized stream of metal particles for deposit in mold 25 as shown. An advantage of a high density stream is that a good dense spray casting 26 of low porosity is obtainable as the mold fills up. This is important insofar as the spray casting of superalloys is concerned.

The mold is supported on table 27 which in turn is adapted for rotation as shown, the mold having an inclined wall such that the axis of the atomized metal stream makes an acute angle therewith, e.g. 15°. The mold is supported via stub shaft 28 centrally located on table 27, the stub shaft being coupled to gear and drive system 29 shown schematically supported by arm 30, e.g. a shuttle arm, extending transversely from the inner wall of melt chamber 10A, the gear and drive system being activated by a flexible drive 32 which is coupled to a motor drive (not shown) outside of the chamber. The shuttle arm 30 is adapted for oscillating or reciprocating motion transverse to the atomized stream of metal 21A. This is achieved by coupling arm 30 to rotatable crank 31 which in turn is coupled to means outside of the chamber (not shown) for effecting oscillating or reciprocating movement of the shuttle arm and hence the mold transverse to the atomized metal stream, the amount of transverse or angular sweep being sufficient to effectively scan the inside of the mold without undue overlapping of the atomized stream outside the mold.

Thus, in a preferred embodiment, two movements of the mold are utilized together, one movement in which the mold rotates about its axis at say 16 rpm and a second movement where the mold is caused to sweep the atomized metal stream transversely in an oscillating or reciprocating motion. We have found that this preferred embodiment provides more uniform ingots with low prosity and low oxygen content. The mold may rotate from about 10 to 40 or 50 rpm.

We have also found it important that, during spray casting, the atomized metal stream be directed so as to strike the interior surface of the confining wall of the mold at an acute angle during the rotation of the mold so that the atomized powder deposited will compact against the side walls to assure a high density product at the side edges of the ingot. One method of achieving this is to provide a mold with the side walls inclined at an acute angle to the axis of the mold, e.g. over 5° and up to 30°, such as 10° to 20°; for example, 15° to 20°. Another method is to support the mold transversely to the stream of atomized metal but at an angle to the horizontal so that the atomized metal stream cannot help but strike the interior wall of the mold at an acute angle as the mold rotates.

Figure 6A:
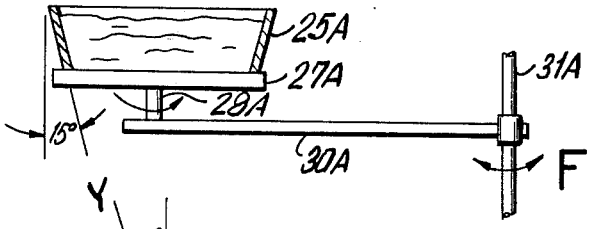
FIGS. 6A, 6B and 6C are illustrative of various embodiments of mold assemblies for carrying out the invention.

One embodiment is shown in FIG. 6A which shows mold 25A supported on rotatable table 27A with a stub shaft 28A extending therefrom and coupled to a drive system on shuttle arm 30A, the shuttle arm being adapted for reciprocating motion by means of crank or pivot 31A. The wall of the mold exhibits a draft of about 15° relative to the axis of the mold and the axis of the metal stream. Thus, as the mold rotates and is caused to sweep back and forth across the tight cone of atomized metal by means of shuttle arm 30A, the stream is caused to impact the mold wall at an acute angle (e.g. 15°), thereby compacting the deposited metal against the mold wall to a high density. The atomized metal stream is also caused to scan the interior of the mold and, because of its high energy, produce a highly dense deposit as well across substantially the cross section of the ingot produced.

Figure 6B:
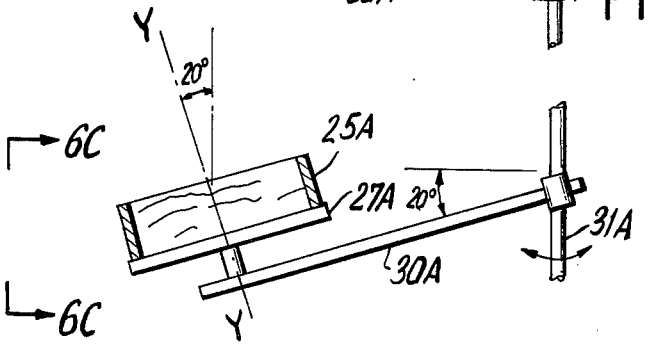
Figure 6C:
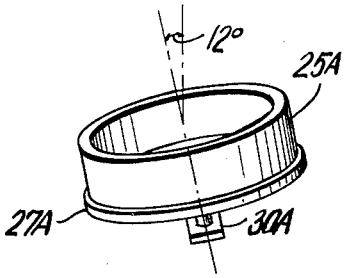

Another preferred embodiment for spray casting an ingot having the desired properties is shown in FIGS. 6B and 6C wherein the mold is supported transverse to the atomized metal stream (not shown) but at an angle of about 20° to the horizontal, the axis Y—Y of the mold being correspondingly tilted 10° from the vertical axis. In addition, the mold may be tilted, e.g. 12° (FIG. 6C), as viewed in the direction of 6C—6C of FIG. 6B, that is opposite to the transverse direction of the shuttle arm. However, this is optional. The mold wall may preferably have a slight draft in which the angle $\alpha$ may range up to about 7°, the numerals of the parts being the same as in FIG. 6A. Consistently high density castings have been obtained with this preferred embodiment.

As stated herein, it is preferred to use the double impact mode system in carrying out the invention as this mode consistently provides a high density tight narrow cone of atomized metal having an included angle of substantially less than 25°, for example, up to about 20°, preferably within 5° to 15°, and more preferably within 5° to 10°.

Figure 9:
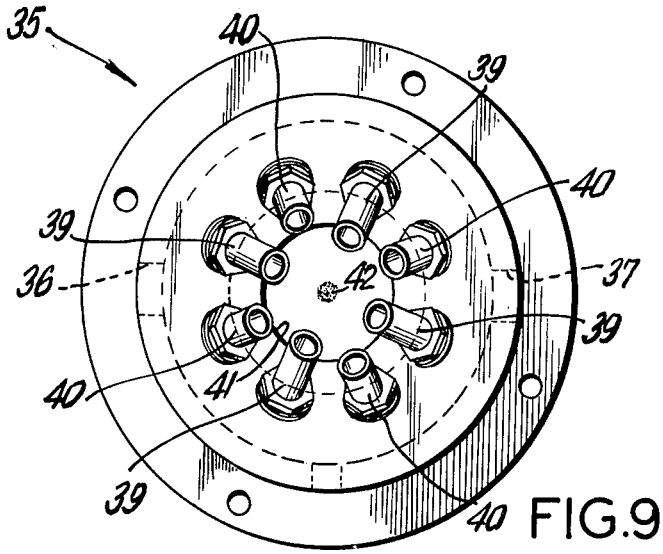
Figure 10:
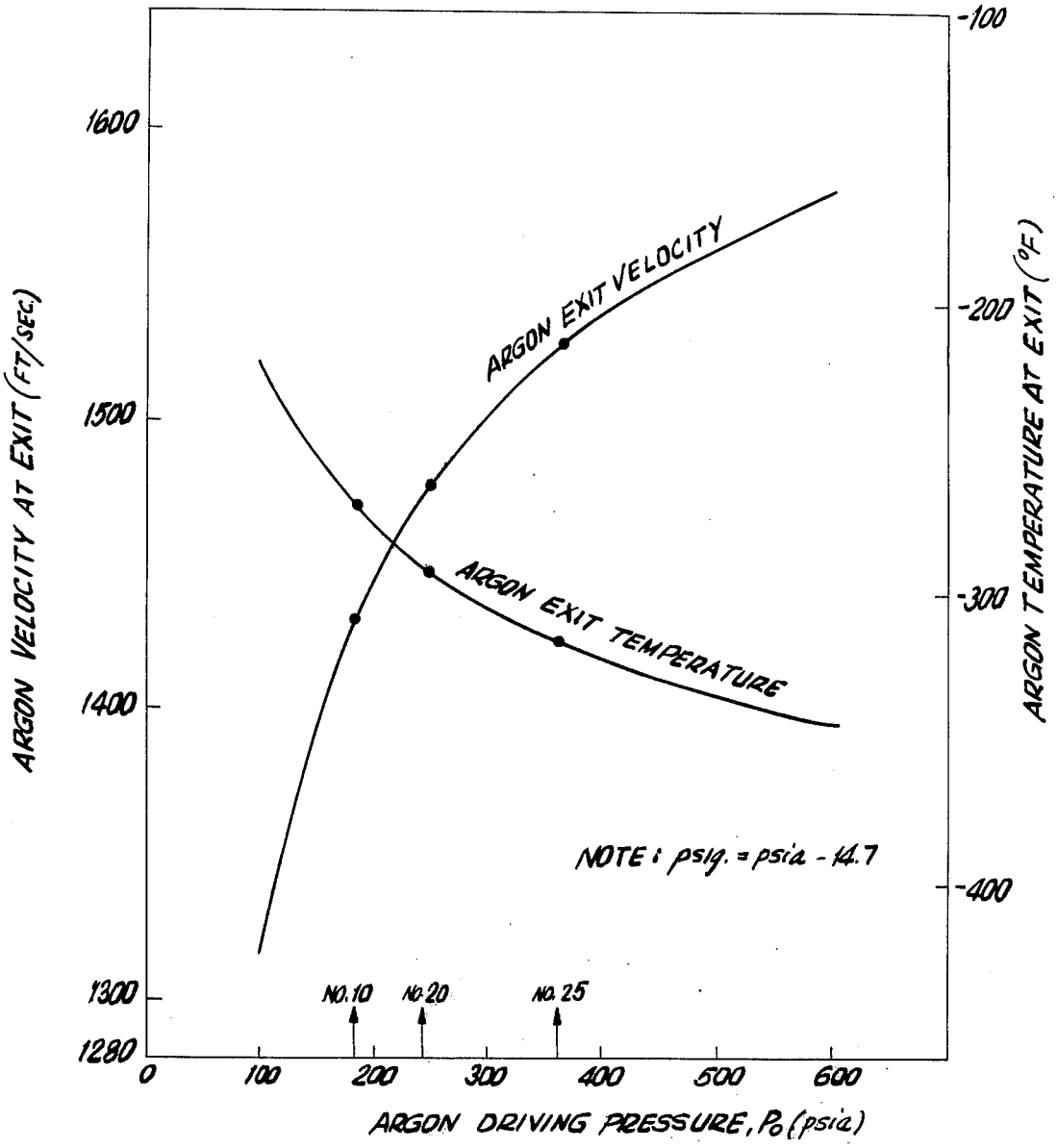
FIG. 10 shows the relationship between argon driving pressure and jet discharge velocity together with gas temperature at discharge.

The double mode system is shown in greater detail in FIGS. 8 and 9, FIG. 9 being a bottom view of plenum chamber 35, FIG. 8 being a view in elevation. The plenum chamber in FIG. 8 is shown having gas entries 36,37 and jet-mounting plugs 38 mounted at an angle and receiving an alternate arrangement of jets 39 and 40, jets 39 being longer than jets 40 (note table of FIG. 4). Referring to FIG. 9, the alternate arrangement of jets 39,40 (four each) will be clearly apparent, the longer jets 39 being diametrically opposite each other, as are the shorter jets 40 to assure a balanced stream of atomizing gas.

The teeming metal stream 42 passes through central opening 41 of the plenum chamber to reach first impact zone 43A where disintegration beings, the included angle of the cone of gas of supersonic velocity being, for example, 25°. When the partially disintegrated metal stream reaches the second impact zone 43B, it is struck by a second cone of supersonic gas at an included angle of say 22° to produce a tight cone 44 of atomized metal with an included angle of about 8° for at least 90% of the stream cross section. Such a high density atomized stream is desirable in producing spray castings having densities of well over 90% and preferably at least about 95% of the actual density of the metal sprayed.

THE ATOMIZATION AND CASTING OF METAL

It is important in carrying out the invention that the teeming stream of molten metal be as smooth as possible with practically no vibration or raggedness. One method of achieving this is to keep the tundish full as far as it is possible during spray casting so as to maintain a constant head during the formation of the casting. Also, so long as the teeming nozzle and the jets are correctly aligned, the atomized metal stream, other things being equal, will be a tight downwardly expanding cone as shown in FIGS. 5A and 8. If the nozzle and jets are out of line, the atomized particles can deviate from the tight zone and modify the desired characteristics of the casting.

Figure 11:
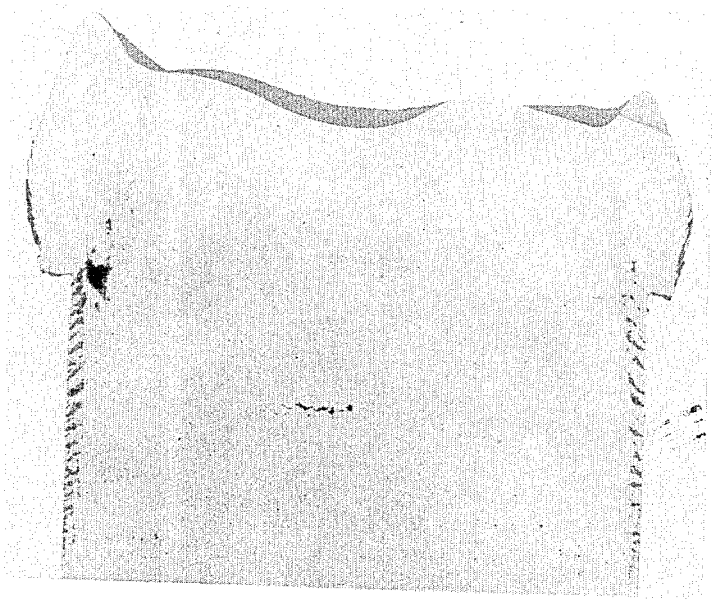
FIG. 11 is a reproduction of a photomacrograph of a section of a spray cast ingot of a superalloy produced in accordance with the invention taken at two-thirds magnification.

If the cone of metal is not tight but has a large included angle (e.g. substantially in excess of 25° or 30°) so that the full effect of the atomizing gas is not obtained along the vertical vector of the atomized metal stream, the ingot may tend to show porosity. Generally speaking, a small amount of porosity may be present even when the casting has a density of at least about 95% of actual density. However, this amount of porosity is very small compared to the prior art discussed hereinbefore. In this connection, note FIG. 11 which is a reproduction of a photomacrograph taken at two-thirds magnification of a spray casting of Astroloy (15.3% Cr, 16.9% Co, 3.5% Ti, 4% Al, 5% Mo, 0.03% B, 0.06% C and the balance essentially nickel) produced in accordance with the invention. Astroloy is a trademark for the foregoing superalloy. Because the spray casting is carried out in the absence of oxygen, any pores which form are clean and easily weld together during hot working. In any event, the ingot in the as-sprayed cast state is generally very dense and exhibits, as stated above, a density of well over 90%, for example, at least about 95% of the actual density of the alloy, preferably at least about 98%.

The time required to teem the melt depends on the size of the nozzle and the head of metal maintained in the tundish as shown schematically in FIG. 1. For example, it is possible to cast an Astroloy melt of about 50 lbs. through a teeming nozzle of about 0.25 inch diameter in about 60 seconds.

The metal to be sprayed is generally heated to a temperature of at least about 40° C and up to about 200° C above the liquidus temperature or melting point of the metal. The liquidus temperature or melting point is defined as that temperature at which the solidus phase is absent. Thus, in the case of the superalloy known by the trademark Astroloy, its pouring temperature is preferably about 1387° C (melting point is 1331° C). Thus, primary cooling from this temperature on gas impact determines the spherical shape of the particles following atomization, minimizes oxygen pickup when the droplets and particles are most susceptible and influences the carbide morphology in the casting. The cooling rates are in hundreds of degrees per second due to the cooling effect of the expanding gas.

An advantage of the invention is that relatively large spray cast shapes having a high degree of supersaturation can be produced as compared to conventionally produced castings which tend to produce segregated structures. The supersaturation condition is due to the fact that at the time of impact, during the production of the spray cast shape, unusually high cooling rates are obtained because of the high density of the deposited metal as compared to cooling rates obtained with conventional gas cooled atomized powders. A potential benefit of this higher degree of supersaturation is easier hot workability, easier control of subsequent precipitation by heat treatment and the capability of manufacturing more complex superalloys not easily made by the more conventional metallurgical techniques.

The parameters which determine the particle cooling rates are the pressure of argon in the plenum chamber and hence the gas temperatures at the jet exit, the jet design, the jet to impact distance, the nozzle-jet alignment and the tundish metal temperature and the teeming rate. The relationship between argon exit velocity in feet per second (supersonic velocity) and argon driving pressure in providing an atomizing gas at super cool temperatures is shown in FIG. 9 in which the argon driving pressure along the abscissa is also correlated to jet Nos. 10, 20 and 25 (note FIG. 4 for the dimensions of these jets). Thus, for jets Nos. 10, 20 and 25, the temperature at the jet exit may vary from about −270° to −316° F (−168° to −193° C), the temperature being shown as the ordinate on the right side of the figure.

The oxygen content of the spray casting is generally below 50 ppm and, more generally, does not exceed about 30 ppm. The oxygen content of superalloy stock prior to atomization may be in the order of about 10 to 15 ppm. Experiments have shown that at about 12 to 18 inches below the atomization zone, the oxygen content of the material may increase to about 18 to 26 ppm which is still a very low oxygen level.

As illustrative of the temperatures which are considered in the argon atomization of molten alloys, the following alloy compositions and temperatures of interest are set forth in Tables 1 and 2, respectively.

Table 1

| ALLOY | % C | % Cr | % Co | % Mo | % W | % Ti | % Al | % Cb | % Ni | % Others |
|---|---|---|---|---|---|---|---|---|---|---|
| IN 100 | 0.18 | 10.0 | 15.0 | 3.0 | — | 4.7 | 5.5 | — | bal. | 0.014 B; 0.06 Zr 1.0 V |
| ASTROLOY | 0.06 | 15.0 | 15.0 | 5.25 | — | 3.5 | 4.4 | — | bal. | 0.03 B |
| ALLOY 713 C | 0.12 | 12.5 | — | 4.2 | — | 0.8 | 6.1 | 2.0 | bal. | 0.012 B; 0.1 Zr |
| RENE 95 | 0.15 | 14.0 | 8.0 | 3.5 | 3.5 | 2.5 | 3.5 | 3.5 | bal. | 0.01 B; 0.05 Zr |
| INCONEL ALLOY 625 | 0.05 | 22.0 | — | 9.0 | — | 0.2 | 0.2 | 4.0 | bal. | 0.15 Mn; 0.3 Si; 3.0 Fe |
| IN-792 | 0.21 | 12.7 | 9.0 | 2.0 | 3.9 | 4.2 | 3.2 | — | bal. | 0.02 B; 0.1 Zr; 2.9 Ta |
| WASPALLOY | 0.07 | 19.5 | 13.5 | 4.3 | — | 3.0 | 1.4 | — | bal. | 0.006 B; 0.09 Zr; 2.0 Fe |
| INCONEL ALLOY 718 | 0.04 | 18.6 | — | 3.1 | — | 0.9 | 0.4 | 5.0 | bal. | 0.2 Mn; 0.30 Si 18.5 Fe |

Table 2

| ALLOY | LIQUIDUS ° C | TUNDISH MELT ° C |
|---|---|---|
| IN-100 | 1328 | 1385 |
| ASTROLOY | 1331 | 1387 |
| ALLOY 713 C | 1334 | 1390 |
| RENE 95 | 1343 | 1427 |
| INCONEL ALLOY 625 | 1345 | 1401 |
| IN-792 | 1346 | 1454 |
| WASPALLOY | 1354 | 1409 |
| INCONEL ALLOY 718 | 1363 | 1418 |

In order to produce consistently a good sound spray casting, it is preferred that the mold be preheated. A typical preheat temperature may range from about 150° to 500° C. Alternatively, the bottom of the mold may be mechanically roughened by shot blasting or machining to promote mechanical bonding and minimize the lifting off of the first deposit of metal in the mold during initial spray casting.

It is preferred that the atomized metal reach the mold at a temperature below the liquidus temperature to minimize heat build-up in the mold and inhibit the local formation of pools of molten metal which is not conducive to forming the desired metallographic structure. In any event, the hot atomized particles of metal reaching the mold should be plastic so as to flatten out and produce a highly dense casting. Thus, the striking temperature of the atomized particles may range from as low as about 85% of the absolute liquidus temperature or melting point and range up to said absolute liquidus or melting point temperature. Preferably, a temperature between the solidus and the liquidus temperature is desirable.

It is also preferred that the atomized stream not impact the mold at one location continuously and, thus, mold movement is desirable to assure substantially uniform scanning and inhibit local overheating of the mold.

As illustrative of one embodiment of the invention, the following example is given in which vacuum melted Astroloy was used as the starting alloy material.

EXAMPLE 1

Astroloy having the nominal composition set forth in Table 1 was melted in an atomizing apparatus of the type shown schematically in FIG. 1, the alloy being melted in a high frequency furnace located above the tundish, the weight of charge being about 50 lbs. (about 23 kg). The tundish was preheated to 1205° C (2200° F) so as to provide an Astroloy heat when poured into the tundish having a temperature of about 1387° C.

The atomizing jets using the No. 20 jet design (eight jets in all with a first set of alternate jets [four jets] focused at one angle, e.g. 25°, and a second set of alternate jets [four jets] focused at a different angle of about 22° to provide the preferred double mode system of impingement illustrated in FIG. 5. The argon driving pressure was about 240 psia (pounds per square inch absolute) to produce an exit average supersonic velocity of the gas issuing from 8 jets of about 1450 feet per second at a temperature of about −290° F (−179° C). The double mode impact produced a tight cone of atomized metal (included angle of about 8°) which was directed into the cylindrical mold supported below it, the mold being approximately 6 inches in diameter and about 2.5 inches high. The mold embodiment employed is that illustrated in FIG. 6B which shows the bottom of the mold disposed at an angle of about 20° with the horizontal. During spray casting, the mold was rotated about its axis at about 16 rpm while being oscillated back and forth to effect scanning of the interior of the mold by the atomized metal stream, the stream striking the interior wall of the mold, with the axis of the stream at an acute angle of about 20° to said wall during the rotation thereof, thereby compacting the deposit against the wall and provide high density throughout substantially the cross section of the ingot. The temperature of the striking stream ranged approximately from about the solidus to the liquidus temperature of the metal steam.

Samples taken from the foregoing ingot assayed about 26 ppm of oxygen. Powder collected from the same heat due to over spraying the mold assayed 60 ppm oxygen, the excess powder having fallen some distance below the mold in the chamber during which it had time to absorb more oxygen due to the high surface area of the powder. Thus, it is clearly apparent that the spary casting of ingots results in a lower content of oxygen as compared to the production of powder per se. Samples of the as spray cast ingot in the machined state exhibited a very high density of about 8 grams/cm$^3$ which compares favorably to the published values of 7.9 to 8.1 grams/cm$^3$ for substantially 100% dense material.

Figure 12:
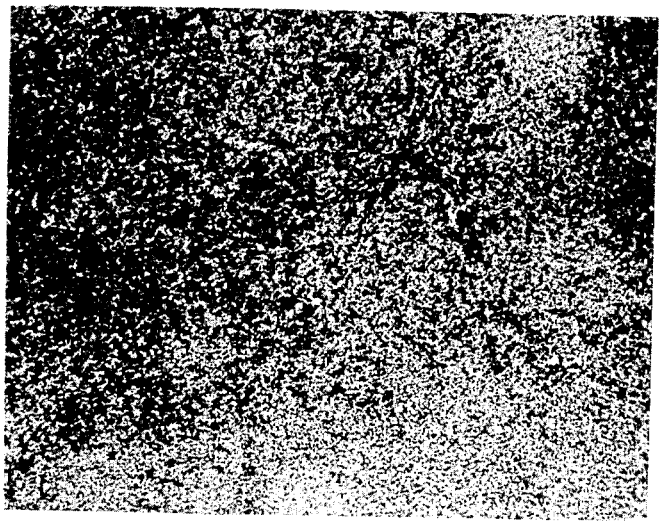
FIG. 12 is a reproduction of a photomicrograph of a spray cast superalloy ingot produced in accordance with the invention taken at 1000 times magnification, the section shown having been etched with Marbles reagent.

The microstructure of the spray casting shows no prior particle boundaries. This is evidenced by the fact that the matrix has undergone grain refinement in situ. The grains are substantially fine (ASTM 7-8) for a casting, the grain size ranging from about 20 to 30 microns in size. Generally, the grain size may range from about 10 to 40 microns. The $\gamma'$ precipitate is relatively uniformly distributed with a slight excess near the grain boundaries and, moreover, there is practically no MC carbide network. In this connection, note FIG. 12 which is a reproduction of a photomicrograph of a section of the cast alloy taken at 1000 times magnification, the alloy having been etched with Marbles reagent.

A machined section was produced from the casting of about 1.4 inches thick and the section cross rolled to about 50% of its original thickness at a temperature of about 1115° C, following which the rolled section was heat treated by solution treatment at 1130° C for 4 hours and oil quenched. The solution treated section was then heated at 860° C for 8 hours, air cooled and then heated at 980° C for 14 hours followed by air cooling. The section was then subjected to precipitation hardening by heating at 650° C for 24 hours followed by air cooling and then heated at 760° C for 8 hours and air cooled. The tensile test specimens exhibited the following properties:

Table 3

| Specimen | Test Temp. (° C) | Yield 0.2% Offset (ksi) | Ultimate Strength (ksi) | Elong. (%) | Reduct. of Area (%) |
|---|---|---|---|---|---|
| Notched | 650° | — | 228.5 | — | — |
| Plain | 650° | 146.3 | 198.2 | 10 | 10 |

As will be noted, the alloy is notch strengthened.

Improved stress rupture properties were also obtained as follows:

Table 4

| Specimen | Test Temp. ° F | Stress (ksi) | Time (hrs.) | Elong. 1" (%) | Reduc. of Area (%) |
|---|---|---|---|---|---|
| | Stress Rupture | | | | |
| Notched | 1400° (760° C) | 85. | 49.5 | — | — |
| Plain | 1400° (760° C) | 85. | 35.9 | 18 | 24.5 |
| Typical P/M Specification | 1400° (760° C) | 85. (minimum) | 23. | 10 | — |

Again, it will be noted that the alloy is notch strengthened (in stress rupture) and exhibits good life. The plain specimen also exhibited good life and very good elongation (% elongation) compared to the typical specification.

EXAMPLE 2

Ten superalloy heats were spray cast into ingots in the manner described in Example 1, with the tundish melt temperature approximately as set forth in Table 2 for IN-792 and Astroloy. Samples taken from the spray cast ingots were tested for oxygen content and density. Powder from the atomized stream which overshot the mold and was collected at the bottom of the container was also assayed for oxygen content for comparison purposes as follows:

Table 5

| Alloy and Heat No. | OXYGEN CONTENT (ppm) Spray Cast Ingot | OXYGEN CONTENT (ppm) Powder | DENSITY (gm cm³) Spray Cast Ingot | DENSITY (gm cm³) Cast and Wrought* |
|---|---|---|---|---|
| IN-792 (1) | 28 | 39 | 8.2 | 8.25 |
| IN-792 (2) | 20 | 74 | 8.0 | 8.25 |
| Astroloy (1) | 26 | 75 | 8.0 | 8.09 |
| Astroloy (2) | 25 | 76 | 7.7 | 8.09 |
| Astroloy (3) | 18 | 68 | 7.8 | 8.09 |
| Astroloy (4) | 14 | 79 | 7.8 | 8.09 |
| Astroloy (5) | 9 | 65 | 7.9 | 8.09 |
| Astroloy (6) | 24 | 61 | 7.7 | 8.09 |
| Astroloy (7) | 25 | 69 | 7.8 | 8.09 |
| Astroloy (8) | 17 | 72 | 7.9 | 8.09 |

*Conventional cast and wrought alloy.

It is clearly apparent that spray cast ingots typically have oxygen contents of less than about one-half of the oxygen of the powder produced from the same heat, the average densities of the as-spray cast ingots being over 95% of the densities given for the conventionally cast and wrought material.

EXAMPLE 3

Four heats of Astroloy were spray cast into ingots as described in Example 1. The ingots were trimmed into a cylindrical shape, two of which were sealed in mild steel cans one-quarter of an inch thick. All of the ingots were heated to 2060° F (1127° C) and then press forged between flat forging platens preheated to 800° F (370° C) to provide a reduction of about 40% to 60% in thickness. None of the forged discs exhibited peripheral crack propagation. Oxygen and density measurements in the forged discs were as follows:

Table 6

| Forged Disc No. | Can | OXYGEN (ppm) | DENSITY (gm/cm³) |
|---|---|---|---|
| 1 | yes | 10 | 7.9 |
| 2 | yes | 10 | 7.94 |
| 3 | no | 26 | 8.02 |
| 4 | no | 20 | 8.02 |

It will be noted that the uncanned specimens forged to a higher density than the canned specimens and exhibited a density of over 98% of the maximum density for Astroloy.

The superalloy ingots produced in accordance with the invention exhibit superplastic properties compared to conventionally produced P/M alloys. The superplastic property of the as-spray cast alloy is evidenced by the fact that discs forged from the machined and heat treated alloy ingot exhibited substantially no peripheral crack propagation during hot press forming.

Specimens were cut from the foregoing forged discs to determine the physical properties thereof. The specimens were heat treated as follows:

Heated to 1115° C for 1 hour and oil quenched
Heated to 650° C for 24 hours and then air cooled
Heated to 760° C for 8 hours and then air cooled The tensile properties were as follows:

Table 7

| Disc No. | Can | Forge Reduc. % | Specimen | Test Temp. (° C) | Yield Offset 0.2% (ksi) | Ult. Str. (ksi) | Elong. (%) | Reduc. of Area (%) |
|---|---|---|---|---|---|---|---|---|
| 1 | yes | 40 | plain | 650° | 149.6 | 186.1 | 7.0 | 8.5 |
| 2 | yes | 60 | plain | 650° | 144.6 | 194.8 | 14.0 | 13.5 |
| 3 | no | 40 | plain | 650° | 142.6 | 194.2 | 17.0 | 15.0 |
| 4 | no | 60 | plain | 650° | 141.0 | 180.5 | 11.0 | 10.1 |
| spec.* | — | — | — | 650° | 143. | 190. | 15. | 25. |

*Typical specification.

As will be noted, the tensile properties at 650° C are substantially comparable with respect to the typical specification properties, except for ductility.

The stress rupture properties at 760° C for the same disc numbers of Table 7 were obtained as follows:

Table 8

| Disc No. | Specimen | Test Temp. (° C) | Stress (ksi) | Life (Hrs.) | Elong. 1" (%) | Reduct. of Area (%) |
|---|---|---|---|---|---|---|
| 1 | plain | 760° | 85 | 51.8 | 5 | 13.5 |
| 2 | plain | 760° | 85 | 59.9 | 18 | 23.6 |
| 3 | plain | 760° | 85 | 59.4 | 34.8 | 23.0 |
| 4 | plain | 760° | 85 | 32.7 | 19.0 | 34.5 |
| Spec.* | — | 760° | 85 | 23. | 10. | — |

*Typical specification

The forged discs all exhibited good stress rupture life, Disc Nos. 2, 3 and 4 exhibiting particularly good ductility.

Low cycle fatigue properties were determined on notched test specimens at 1200° F (650° C) using a Kt of 3.5, Kt being a notch factor for a notch in which the radius of curvature at the bottom of the notch is 0.009 inch, the Kt for a plain test specimen being one. The Kt is a measure of the severity of the notch. The results obtained are as follows:

Table 9

| Disc No. | Can | Forge Reduct (%) | Specimen | Rate (cpm) | Stress* (ksi) | No. of Cycles | P/M Comparison Cycles |
|---|---|---|---|---|---|---|---|
| 1 | yes | 40 | notched | 10 | 5–120 | 1,211 | 500 |
| 1 | yes | 40 | notched | 10 | 5–100 | 2,382 | 1,500 |
| 1 | yes | 40 | notched | 10 | 5–75 | 9,757 | 5,000 |
| 2 | yes | 60 | notched | 10 | 5–120 | 1,250 | 500 |
| 2 | yes | 60 | notched | 10 | 5–100 | 2,083 | 1,500 |
| 2 | yes | 60 | notched | 10 | 5–75 | 8,672 | 5,000 |
| 3 | no | 40 | notched | 10 | 5–120 | 1,396 | 500 |
| 3 | no | 40 | notched | 10 | 5–100 | 2,400 | 1,500 |
| 3 | no | 40 | notched | 10 | 5–75 | 13,086 | 5,000 |
| 4 | no | 60 | notched | 10 | 5–120 | 779 | 500 |
| 4 | no | 60 | notched | 10 | 5–100 | 2,291 | 1,500 |
| 4 | no | 60 | notched | 10 | 5–75 | 10,692 | 5,000 |

*Stress applied cyclically from the low stress shown to the high stress shown for each specimen at 10 cycles per minute.

It will be noted that the low cycle fatigue properties of the four forged discs compare very favorably with those of the conventionally produced P/M alloy at all levels of stress tested.

EXAMPLE 4

Another heat of Astroloy was spray cast into an ingot as described in Example 1. The ingot was machined into a turbine disc preform, heated to 2060° F (1127° C) and then press forged between shaped dies preheated at 800° F (370° C). The forged disc did not exhibit peripheral crack propagation. The oxygen level in the forged disc was 14 ppm and the density 8 grams/cm$^3$. Metallographically, the ingot had very fine grains.

A sample from the disc preform was heat treated as follows:

Heated to 650° C for 24 hours and air cooled

Heated to 760° C for 8 hours and air cooled

The tensile properties following the foregoing heat treatment were as follows:

Table 10

| Test No. | Type | Test Temp. (° C) | Yield Offset 0.2% (ksi) | Ult. Stress (ksi) | Elong. 1" (%) | Reduct. of Area (%) |
|---|---|---|---|---|---|---|
| 1 | Plain | 650° | 154.7 | 211.5 | 16.5 | 14.5 |
| Spec.* | — | 650° | 143. | 190. | 15. | 25. |

*Typical specification.

It will be apparent from the foregoing test that heat treatment without subjecting the specimen to solution treatment at 1115° C increases the high temperature tensile properties significantly with satisfactory elongation.

Four more specimens were cut from the forged disc preform for tensile tests; two were solution treated at 1090° C for 2 hours followed by air cooled and the other two solution treated at 1040° C for 2 hours and also air cooled. All four specimens were heated to 650° C for 24 hours, air cooled and then heated to 750° C for 8 hours and air cooled. The following tensile properties were obtained on plain and notched tensile specimens using a notch factor of Kt = 3.5 as mentioned hereinbefore, the plain specimen having a Kt factor of 1.

Table 11

| Test No. | Type | Solution Temp. (° C) | Test Temp. (° C) | Yield Offset 0.2% (ksi) | Ult. Str. (ksi) | Elong. 1" (%) | Reduct. of Area (%) |
|---|---|---|---|---|---|---|---|
| 2 | notched | 1090° C | 650° C | — | 234.7 | — | — |
| 3 | plain | 1090° C | 650° | 139.2 | 186.9 | 12.0 | 14.0 |
| 4 | notched | 1040° C | 650° | — | 230.3 | — | — |

Table 11-continued

| Test No. | Type | Solution Temp. (° C) | Test Temp. (° C) | Yield Offset 0.2% (ksi) | Ult. Str. (ksi) | Elong. 1" (%) | Reduct. of Area (%) |
|---|---|---|---|---|---|---|---|
| 5 | plain | 1040° C | 650° | 143.1 | 194.6 | 13.0 | 16.5 |

Two more specimens for stress rupture tests were cut from the disc preform. One was solution treated at 1090° C for 2 hours followed by air cooling, while the other was solution treated at 1040° C for two hours and air cooled. Both samples were then heated to 650° C for 24 hours, air cooled and then heated to 760° C for 8 hours and air cooled. The following stress rupture properties were obtained with a notch Kt of 3.5 as follows:

Table 12

| Test No. | Type | Solution Temp. (° C) | Test Temp (° C) | Stress (ksi) | Life (hours) | Elong. 1" (%) | Reduc. of Area (%) |
|---|---|---|---|---|---|---|---|
| 6 | notch/ plain | 1090°C | 760° | 85 | 71.5 | 13.0 | 16.8 |
| 7 | notch/ plain | 1040° | 760° | 85 | 40.3 | 16.0 | 32.5 |
| Spec.* | Plain | — | 760° | 85 | 23. (minimum) | 10. | — |

*Typical specification.

Both specimens exhibited good life and ductility, with specimen 7 especially showing good ductility. The results compare favorably with the typical specification.

The examination of the microstructure at 200 times magnification of the forged specimens (40 to 60% reduction) solution treated at 1090° C and 1040° C above revealed similar duplex grain structures comprising fine elongated grains of about ASTM 7–8 (approximately 20 to 30 microns) surrounded by a necklace of very fine grains of ASTM 10–12 (substantially less than 20 microns, e.g. about 7 to 10 microns), as shown in FIG. 13. The duplex structure is more pronounced after solution heat treatment at 1040° C. The $\gamma'$ precipitate is relatively uniformly distributed and there is practically no MC carbide network.

EXAMPLE 5

A heat of pure zinc of about 42.7 kilograms was spray cast in accordance with the invention. The zinc was similarly melted as described in Example 1 except that the tundish was preheated to 1000° F (538° C). The metal which has a melting point of 419.4° C (787° F) was tapped from the furnace at about 900° F (483° C) and the temperature in the tundish was determined as 940° F (505° C). The tundish nozzle (venturi) had a diameter of 0.27 inch.

A total of eight No. 10 jets were mounted in the plenum, a first alternate set of four being mounted to define an included angle of 25° and a second alternate set of four being mounted to define an included angle of 22°, the two sets combining to provide a double mode impact system as shown schematically in FIG. 5.

The argon was varied over an atomization pressure range starting at 70 psig and reaching 200 psig at steady state conditions. The mold was 6 inches in diameter and about 3½ inches high. The mold was rotated at a speed of about 16 rpm. The shuttle arm supporting the mold was at an angle of 20° (note FIG. 6B), the mold in turn also being tilted opposite to the transverse direction of the shuttle arm at an angle of 12° (note FIG. 6C). The shuttle arm was also oscillated; thereby effecting scanning of the mold by the atomized metal stream. The angle of tilt may vary from 5° to 45° and preferably from 5° to 25°.

The distance from the base of the jets at the plenum chamber to the mold was 32 inches. The final ingot contained 655 ppm of oxygen as compared to the oxygen content of 5000 ppm in the powder collected at the bottom of the apparatus. The density of the ingot was over about 90% of actual density and ranged up to about 97.4%.

A cross section of a portion of the machined ingot is shown in FIG. 14 taken at 200 times magnification.

As is apparent, the invention is applicable to metals having a wide range of melting points, such as zinc having a melting point of 419.4° C and superalloys having a melting point of over 1300° C, e.g. 1350° C and higher. Thus, metals can be cast having melting points of over about 400° C and ranging up to about 1500° C or 1600° C, e.g. 1000° C to 1600° C.

While the preferred embodiment of the invention is directed to the use of argon as the atomizing gas or fluid, it will be appreciated that other atomizing fluids may be employed, such as steam or water, depending upon the metals to be atomized. However, in the production of superalloys, argon is the preferred atomizing gas to inhibit oxidation as far as possible.

As stated herein, it is important in obtaining consistent results that the axis of the atomized metal stream be disposed at an acute angle to the interior wall of the mold. For example, the acute angle may range from about 5° to 45° and, preferably from about 5° to 25°. Where the higher acute angles are used, it is desirable that the height of the mold not exceed its diameter or width, especially if an angle of 45° is used.

By impacting the interior wall with a tight cone of the atomized metal stream and with the axis thereof at an acute angle with the wall, a compacted deposit is obtained in which the surface of the ingot adjacent the mold wall has the desired high density and integrity as well as the interior of the ingot. If the mold is filled directly without impacting against the mold wall, the surface of the ingot adjacent the mold wall tends to be porous and loose.

An advantage of using a tight narrow cone of atomized metal in producing a spray cast ingot of high density resides in the fact that a substantially large portion of the atomized metal is captured by the mold. That part of the stream that misses the mold during scanning produces good atomized powder which has utility in P/M processes. However, this powder generally contains more oxygen than the ingot deposited in the mold.

The tight narrow cone is also indicative of the fact that greater use is made of the vertical vector of supersonic gas flow which assures high impact forces against the wall of the mold as well as against the bottom thereof. The atomized particles of metal being in a plastic state thereby flatten out on impact to provide high density. This is supported by the structure illustrated in FIG. 12 in which particle boundaries are no longer discernible as in prior art sprayed products, the deposited metal having undergone grain refinement in situ.

The process is applicable to the continuous spray casting of longer ingots by employing a mold with a movable plug at its bottom which is gradually withdrawn to cause the ingot to move downward. Vibration means may be employed as in the continuous casting of metals to aid in the smooth removal of the ingot. The mold, for example, may have a slightly inwardly inclined wall to aid in the bottom removal of the ingot, so long as the mold is tilted to provide the desired angle of impact of the metal stream against the interior wall of the mold.

Generally speaking, the as-sprayed metal ingot is characterized by a grain size falling within the range of about 10 microns to 40 microns, for example, about 20 to 35 microns. This is unexpected for a cast ingot. An advantage of such spray cast structures is that normally difficult-to-work alloys exhibit greater plasticity when produced in accordance with the invention as evidenced by the fact that a casting of the foregoing composition was, following machining, successfully hot forged into a shape of a turbine disc preform. In addition to turbine discs, the invention is also applicable to the production of other forged shapes, such as turbine blades, shafts, casings, and to difficult-to-cast extrusion dies, to the production of shapes for producing corrosion resistant strips and tubes and corrosion/erosion resistant shapes and the like.

Thus, the invention provides, in addition to the process, a high density, fine grained metal ingot in the as-spray cast condition characterized by a grain size falling within the range of about 10 to 40 microns, a density substantially over 90%, and preferably at least about 95%, of the actual density of the metal and further characterized by being substantially free from particle boundaries of atomized metal particles employed in producing the ingot, such that substantially all of the dendrites present do not exceed the average grain size of said as-spray cast ingot.

This invention is also directed to an apparatus for producing a spray cast ingot comprising a vertically disposed confining chamber capable of being drawn to a high vacuum, means for melting a charge of metal located in an upper portion of said chamber, a tundish disposed in communicating distance with said melting means for receiving molten metal therefrom, said tundish having a teeming nozzle located in the bottom region thereof, an enclosed annular plenum chamber supported beneath said tundish, the annular plenum chamber being characterized by a central opening coaxially aligned with the teeming nozzle and adapted to pass a teeming stream of molten metal therethrough from said teeming nozzle, the plenum chamber having at least one gas entry port for receiving atomizing gas under pressure therein, jet means comprising a plurality of jets extending downwardly at an angle from the plenum chamber and communicating with the interior of said chamber, said jets being substantially equally spaced and surrounding the central opening of said annular plenum chamber and disposed to define a cone of impingement on a teeming metal stream when formed to pass through the central opening of said plenum chamber, such that high pressure gas discharged from the jets at supersonic velocity impinges on the molten metal stream when formed and atomizes it to form an outwardly expanding cone of atomized metal, and a mold located below the jets and disposed in a plane transverse to the path of travel of the atomized metal stream when formed, said jet means and said mole being adapted to relative movement, one to the other, whereby said atomized metal stream when formed effectively scans the interior wall of said mold by virtue of the movement of said mold.

As stated earlier, the invention is applicable to metals having melting points as low as zinc and ranging to as high as the melting points of superalloys and higher. The invention is particularly applicable to metals having melting points above 1000° C.

Thus, the invention is applicable to the production of heat resistant alloys, such as superalloys. While some of the superalloys have been referred to by way of illustration hereinbefore, particularly difficulty workable alloys containing over about 4% or 5% total of the precipitation hardening elements aluminum and titanium and fairly substantial amounts of at least one matrix stiffening element selected from the group consisting of molybdenum, niobium, tantalum, tungsten, vanadium, among others, the invention is to be understood to be applicable to a broad range of alloys.

Among the alloys that can be spray cast in accordance with the invention are those based on at least one of the iron-group metals iron, nickel and cobalt and thus may be iron-base, nickel-base and cobalt-base superalloys. Such alloys may contain at least about 40% of at least one iron-group metal, it being understood that the minimum of about 40% may comprise iron alone, nickel alone, cobalt alone or may comprise two or three of these elements which together add up to at least about 40% of the total composition.

Thus, such alloys may comprise by weight up to about 60%, e.g. about 1% to 25%, chromium; up to about 30%, e.g. 5% to 25%, cobalt where the alloy is deemed either a nickel-base or iron-base alloy; up to about 10%, e.g. about 1% to 9%, aluminum; up to about 8%, e.g., about 1% to 7%, titanium, and particularly those alloys containing 4% or 5% or more of aluminum plus titanium; up to about 30%, e.g. about 1% to 8%, molybdenum; up to about 25%, e.g., about 2% to 20%, tungsten; up to about 10% columbium; up to about 10% tantalum; up to about 7% zirconium; up to about 0.5% boron; up to about 5% hafnium; up to about 2% vanadium; up to about 6% copper; up to about 5% manganese; up to about 4% silicon, and the balance essentially at least about 40% of at least one iron-group metal from the group iron, nickel and cobalt.

Among the specific superalloys might be listed those known by the designations IN-738 and 792, Rene alloys 41 and 95, Alloy 718, Waspaloy, Astroloy, Mar-M alloys 200 and 246, Alloy 713, Alloys 500 and 700, A-286, Nimonic 95, Nimonic 105, Nimonic 115, and many others. Various of these alloys are more workable than others. Other base alloys such as titanium can be processed as well as refractory alloys such as SU-16, TZM and Zircaloy. In working with titanium-base alloys and similar metals, the melting crucible and the tundish should be made of materials substantially inert to such metals at elevated temperatures. Prealloys contemplated herein can contain up to 10% or more by volume of a dispersoid, such as $Y_2O_3$, $ThO_2$, $La_2O_4$, and other refractory materials.

The term "ingot" employed herein is meant to encompass any cast body, such as hollow and solid shapes, billets, preforms or cast articles having a desired final configuration and other body shapes.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A process for producing a spray cast metal ingot characterized by high density in the as-spray cast condition of substantially over 90% of the actual density of the metal which comprises, providing a highly energetic conically configurated outwardly expanding atomized metal stream having an included angle of substantially less than 25°, directing said atomized stream of metal to the interior of an ingot mold with the longitudinal axis of said stream disposed at an acute angle to the interior wall of said mold, while effecting relative transverse movement between said atomized metal stream and said mold, such that said stream is caused to scan the interior of said mold, and filling said mold while scanning the interior thereof.

2. The process of claim 1, wherein said highly energetic atomized metal stream is produced by impinging a teeming metal stream with an atomizing fluid flowing at supersonic velocity and coaxially in the direction of said teeming metal stream.

3. The process of claim 2, wherein the included angle of said conically configurated metal stream does not exceed about 20°.

4. The process of claim 3, wherein said included angle ranges from about 5° to 15°.

5. The process of claim 4, wherein said included angle ranges from about 5° to 10°.

6. The process of claim 2, wherein the temperature of the atomized metal ranges from about 85% of its absolute melting point to about its melting point.

7. The process of claim 2, wherein the axis of said metal stream is disposed at an acute angle to the interior wall of said mold of about 5° to 45°.

8. A process for producing a spray cast metal ingot characterized by high density in the as-spray cast condition of substantially over 90% of the actual density of the metal which comprises, providing a highly energetic conically configurated outwardly expanding atomized metal stream produced by impinging a teeming metal stream with a non-oxidizing atomizing gas flowing at supersonic velocity and coaxially in the direction of said teeming metal stream such that the resulting atomized metal stream has an included angle of substantially less than 25°, directing said atomized stream of metal to the interior of an ingot mold with the longitudinal axis of said stream disposed at an acute angle to the interior wall of said mold, while effecting relative transverse movement between said atomized metal stream and said mold, such that said stream is caused to scan the interior of said mold, and filling said mold while scanning the interior thereof.

9. The process of claim 8, wherein the included angle of said conically configurated metal stream does not exceed about 20°.

10. The process of claim 9, wherein said included angle ranges from about 5° to 15°.

11. The process of claim 10, wherein said included angle ranges from about 5° to 10°.

12. The process of claim 8, wherein the temperature of the atomized metal ranges from about 85% of its absolute melting point to about its melting point.

13. The process of claim 8, wherein the axis of said metal stream is disposed at an acute angle to the inner surface of the wall of said mold of about 5° to 25°.

14. A process for producing a spray cast metal ingot characterized by high density of substantially over 90% of the actual density of the metal which comprises:

providing a teeming stream of molten metal under substantially non-oxidizing conditions, allowing said molten metal stream to pass longitudinally and centrally though a hollow converging conical jet stream of super cooled non-oxidizing atomizing gas flowing at supersonic velocity downwardly and coaxially of said molten metal stream, the conical gas stream being focused at said supersonic velocity to impinge substantially symmetrically against said coaxially disposed molten metal stream in the direction of flow thereof and at a conical angle of impingement of less than 30° to produce a highly energetic outwardly expanding conically configurated atomized stream of molten metal with an included angle of substantially less than 25°, directing said conically configurated atomized stream of metal into the interior of an ingot mold supported transverse to the path of said energetic metal stream with the longitudinal axis of said metal stream disposed at an acute angle to the interior wall of said mold, causing said atomized stream of metal to scan the interior of said mold and strike the wall thereof at an acute angle by effecting relative transverse movement between said atomized metal stream and said mold to promote substantially uniform filling thereof, and continuing the filling of said mold with the axis of said atomized metal stream directed at said acute angle to the interior wall of said mold until the mold has been filled, thereby obtaining a compact high density spray cast ingot having an average density of substantially over 90% of the actual density of said metal.

15. The process of claim 14, wherein said mold is moved relative to said atomized metal stream by rotation about its axis and by oscillating said mold across said stream of atomized metal.

16. The process of claim 14, wherein said jet stream of atomizing gas is produced by a plurality of jets substantially equally spaced in a circle and projecting downwardly at an angle to produce said conical angle of impingement of less than about 30° and wherein the axis of the metal stream is disposed at an acute angle to the interior wall of said mold of about 5° to 25°.

17. The process of claim 16, wherein said plurality of jets is arranged to provide following impingement of said atomizing gas a highly energetic tight cone of atomized metal having an included angle not exceeding about 20°.

18. The process of claim 17, wherein the plurality of jets is arranged to provide a tight cone of highly energetic stream of atomized metal having an included angle of about 5° to 15°.

19. The process of claim 18, wherein said tight cone of said highly energetic stream of atomized metal has an included angle of about 5° to 10°.

20. The process of claim 17, wherein the temperature of the atomized metal stream reaching the mold ranges from about 85% of the absolute melting point of the metal to its absolute melting point.

21. The process of claim 14, wherein the exit velocity of the atomizing gas leaving the jets is at least about Mach No. 1.5.

22. The process of claim 21, wherein the exit velocity of the atomizing gas leaving the jets is at least about Mach No. 2.

23. The process of claim 14, wherein the atomizing gas is argon.

24. The process of claim 14, wherein the teeming rate of the metal stream ranges from about 10 to 70 kg/min.

25. The process of claim 17, wherein the teeming rate of the metal stream ranges from about 25 to 50 kg/min.

26. The process of claim 24, wherein the nozzle through which the molten metal is teemed ranges in throat diameter from about 0.2 inch and up to about 0.375 inch.

27. The process of claim 17, wherein the gas is argon, the teeming rate of the molten metal through the nozzle ranges from about 10 to 70 kg/min., the throat diameter of the nozzle from about 0.2 inch to about 0.375 inch and the kinetic energy generated at the exits of the jets is correlated with the argon driving pressure and jet throat diameter as set forth in FIG. 7.

28. The process of claim 14, wherein said jet stream of atomizing gas is produced by a plurality of jets substantially equally spaced in a circle with a first set of alternate jets projecting downwardly to define an included conical angle of impingement of less than about 30° and a second set of alternate jets projecting downwardly to define an included conical angle of at least 2° less than the angle formed by said first set, thereby providing a double impact mode system on said teeming molten metal stream in which the impingement produced by said second set of alternate jets is below the impingement produced by said first set of jets, such that by virtue of said double mode impact, a relatively tight cone of atomized metal is produced having an included angle of substantially less than 25° C.

29. The process of claim 28, wherein said mold is moved relative to said atomized metal stream by rotation about its axis and by oscillating said mold across said stream of atomized metal.

30. The process of claim 28, wherein the arrangement of said first and second jets is such as to produce a highly energetic tight cone of atomized metal having an included angle not exceeding 20°.

31. The process of claim 30, wherein the arrangement of said first and second jets is such as to provide a tight cone of highly energetic stream of atomized metal having an included angle of about 5° to 15°.

32. The process of claim 31, wherein said tight cone of atomized metal has an included angle of about 5° to 10°.

33. The process of claim 28, wherein the temperature of the atomized metal stream reaching the mold ranges from about 85% of the absolute melting point of the metal to its absolute melting point.

34. The process of claim 28, wherein the exit velocity of the atomizing gas leaving the jets is at least about Mach No. 1.5.

35. The process of claim 34, wherein the exit velocity of the atomizing gas leaving the jets is at least about Mach No. 2.

36. The process of claim 28, wherein the atomizing gas is argon.

37. The process of claim 28, wherein the teeming rate of the metal stream ranges from about 10 to 70 kg/min.

38. The process of claim 30, wherein the teeming rate of the metal stream ranges from about 25 to 50 kg/min.

39. The process of claim 37, wherein the nozzle through which the molten metal is teemed ranges in throat diameter from about 0.2 inch and up to about 0.375 inch.

40. The process of claim 30, wherein the gas is argon, the teeming rate of the molten metal through the nozzle ranges from about 10 to 70 kg/min., the throat diameter of the nozzle from about 0.2 inch to about 0.375 inch, and the kinetic energy generated at the exits of the jets is correlated with the argon driving pressure and jet throat diameter as set forth in FIG. 7.

41. A process for producing a spray cast metal ingot characterized by high density of substantially over 90% of the actual density of the metal which comprises:

tapping a charge of molten metal into a tundish, teeming the metal from the tundish through a teeming nozzle to form a molten stream, allowing said molten metal stream to pass longitudinally and centrally through a hollow converging conical jet stream of super cooled non-oxidizing atomizing gas flowing at supersonic velocity produced by a plurality of jets substantially equally spaced in a circle with a first set of alternate jets projecting downwardly to define an included conical angle of impingement with said molten metal stream of less than about 30° and a second set of alternate jets projecting downwardly to define an included conical angle of at last 2° less than the angle formed by said first set, thereby providing a double impact mode system on said teeming molten metal stream in which the impingement produced by said second set of alternate jets is below the impingement produced by said first set of jets, such that, by virtue of said double mode impact, a relatively tight cone of atomized metal is produced having an included angle substantially less than 25°, directing said conically configurated atomized stream of metal into the interior of an ingot mold supported transverse to the path of said energetic metal stream with the longitudinal axis of said metal stream disposed at an acute angle of about 5° to 45° to the interior wall of said mold, causing said atomized stream of metal to scan the interior of said mold and strike the wall thereof at said acute angle while rotating said mold about its axis and oscillating said mold across the path of said stream to promote substantially uniform filling of said mold, and continuing the filling of said mold, thereby obtaining a compact high density spray cast ingot having an average density of substantially over 90% of the actual density of said metal.

42. The process of claim 41, wherein the arrangement of said first and second jets is such as to produce a highly energetic tight cone of atomized metal having an included angle not exceeding 20° and wherein the acute angle of the axis of the atomized metal stream with the interior wall of the mold ranges from about 5° to 25°.

43. The process of claim 42, wherein the arrangement of said first and second jets is such as to provide a tight cone of highly energetic stream of atomized metal having an included angle of about 5° to 15°.

44. The process of claim 43, wherein said tight cone of atomized metal has an included angle of about 5° to 10°.

45. The process of claim 41, wherein the temperature of the atomized metal stream reaching the mold ranges from about 85% of the absolute melting point of the metal to its absolute melting point.

46. The process of claim 41, wherein the exit velocity of the atomizing gas leaving the jets is at least about Mach No. 1.5.

47. The process of claim 46, wherein the exit velocity of the atomizing gas leaving the jets is at least about Mach No. 2.

48. The process of claim 41, wherein the atomizing gas is argon.

49. The process of claim 41, wherein the teeming rate of the metal stream ranges from about 10 to 70 kg/min.

50. The process of claim 42, wherein the teeming rate of the metal stream ranges from about 25 to 50 kg/min.

51. The process of claim 49, wherein the nozzle through which the molten metal is teemed ranges in throat diameter from about 0.2 inch up to about 0.375 inch.

52. The process of claim 42, wherein the gas is argon, the teeming rate of the molten metal through the nozzle ranges from about 10 to 70 kg/min., the throat diameter of the nozzle from about 0.2 inch to about 0.375 inch, and the kinetic energy generated at the exits of the jets is correlated with the argon driving pressure and jet throat diameter as set forth in FIG. 7.

* * * * *